US010267062B2

(12) United States Patent
Lai

(10) Patent No.: US 10,267,062 B2
(45) Date of Patent: Apr. 23, 2019

(54) ELECTRONIC COMBINATION LOCK WITH DIFFERENT LEVELS OF ACCESS CONTROL

(71) Applicant: The Sun Lock Company Ltd., Tuen Mun, N.T. (HK)

(72) Inventor: Karl Lai, Tai Po (HK)

(73) Assignee: The Sun Lock Company, Ltd., Tuen Mun, N.T. (HK)

( * ) Notice: Subject to any disclaimer, the term of this patent is extended or adjusted under 35 U.S.C. 154(b) by 86 days.

(21) Appl. No.: 15/351,708

(22) Filed: Nov. 15, 2016

(65) Prior Publication Data

US 2017/0169637 A1 Jun. 15, 2017

Related U.S. Application Data

(60) Provisional application No. 62/266,052, filed on Dec. 11, 2015.

(51) Int. Cl.
*E05B 37/00* (2006.01)
*E05B 47/00* (2006.01)
(Continued)

(52) U.S. Cl.
CPC ..... *E05B 47/0012* (2013.01); *E05B 17/226* (2013.01); *E05B 37/0034* (2013.01);
(Continued)

(58) Field of Classification Search
CPC .... E05B 17/2011; E05B 17/22; E05B 17/226; E05B 37/0031; E05B 37/0034;
(Continued)

(56) References Cited

U.S. PATENT DOCUMENTS 4,062,056 A 12/1977 Goodrich
4,148,092 A 4/1979 Martin
(Continued)

FOREIGN PATENT DOCUMENTS

CN 2439512 7/2001
CN 203796000 8/2014
(Continued)

OTHER PUBLICATIONS

American Security LaGard Electronic Locks, http://www.amsecusa.com/lock-options/lagard-electronic-locks, printed Nov. 2, 2015 (3 pages).

(Continued)

*Primary Examiner* — Christopher J Boswell
(74) *Attorney, Agent, or Firm* — Ware, Fressola, Maguire & Barber LLP

(57) ABSTRACT

An electronic combination lock has a touch panel for combination code entry. If the combination code matches a preset code, a solenoid in energized to unlock the lock, allowing a user to pull up the shackle to open the lock. The user can be a master user, a regular user or a temporary user with each type of users having different level of access. For example, the master user can have unlimited number of times to use the master combination code, while a temporary user has only a limited number of times to use its temporary code as designated by the master user. In one embodiment, the lock can be opened with a key. In another embodiment, the user can enter the combination code from a detached electronic device.

20 Claims, 17 Drawing Sheets

(51) Int. Cl.

| | |
|---|---|
| ***E05B 17/22*** | (2006.01) |
| ***E05B 47/06*** | (2006.01) |
| ***E05B 49/00*** | (2006.01) |
| ***E05B 67/00*** | (2006.01) |
| ***E05B 67/22*** | (2006.01) |
| ***G07C 9/00*** | (2006.01) |
| ***E05B 67/24*** | (2006.01) |

(52) U.S. Cl.
CPC ..... *E05B 37/0048* (2013.01); *E05B 37/0068* (2013.01); *E05B 47/0004* (2013.01); *E05B 47/06* (2013.01); *E05B 49/00* (2013.01); *E05B 67/00* (2013.01); *E05B 67/22* (2013.01); *E05B 67/24* (2013.01); *G07C 9/0069* (2013.01); *G07C 9/00944* (2013.01); *E05B 2047/0024* (2013.01); *E05B 2047/0048* (2013.01); *E05B 2047/0054* (2013.01); *E05B 2047/0058* (2013.01); *E05B 2047/0085* (2013.01); *E05B 2047/0086* (2013.01); *G07C 2209/08* (2013.01)

(58) Field of Classification Search
CPC .. E05B 37/0048; E05B 37/0068; E05B 47/00; E05B 47/0001; E05B 47/0012; E05B 47/02; E05B 2047/0014; E05B 2047/0015; E05B 2047/0018; E05B 2047/0024; E05B 2047/0048; E05B 2047/005; E05B 2047/0054; E05B 49/00; E05B 67/00; E05B 67/22; E05B 67/24
See application file for complete search history.

(56) References Cited

U.S. PATENT DOCUMENTS

| | | | | |
|---|---|---|---|---|
| 4,677,284 | A | 6/1987 | Genest | |
| 4,838,052 | A * | 6/1989 | Williams | E05B 19/0005 109/52 |
| 4,931,789 | A | 6/1990 | Pinnow | |
| 5,021,776 | A | 6/1991 | Anderson et al. | |
| 6,046,558 | A | 4/2000 | Larson et al. | |
| 6,401,501 | B1 * | 6/2002 | Kajuch | E05B 67/22 63/38 |
| 6,411,195 | B1 | 6/2002 | Goldman | |
| 6,442,983 | B1 | 9/2002 | Thomas et al. | |
| 6,898,952 | B1 * | 5/2005 | Lin | E05B 47/0012 70/280 |
| 7,782,200 | B1 | 8/2010 | Fleischmann | |
| 7,880,585 | B1 * | 2/2011 | Aronson | E05B 45/005 340/5.64 |
| 7,948,359 | B2 * | 5/2011 | Marcelle | G07C 9/00182 340/5.64 |
| 8,225,629 | B2 | 7/2012 | Zuraski et al. | |
| 8,353,187 | B2 | 1/2013 | Woodling | |
| 8,453,481 | B2 | 6/2013 | Meekma | |
| 8,638,227 | B2 | 1/2014 | Yuan | |
| 8,640,513 | B2 * | 2/2014 | Goren | E05B 47/0603 340/5.2 |
| 8,806,907 | B2 | 8/2014 | Kalous et al. | |
| 8,850,858 | B2 * | 10/2014 | Nave | E05B 67/22 70/21 |
| 9,000,917 | B1 | 4/2015 | Meyers | |
| 9,059,576 | B2 | 6/2015 | Isaacks et al. | |
| 9,109,379 | B1 * | 8/2015 | Ranchod | E05B 67/00 |
| 9,121,199 | B2 | 9/2015 | Li | |
| 9,540,845 | B1 * | 1/2017 | Yang | E05B 19/0005 |
| 9,556,651 | B1 * | 1/2017 | Cabral Herrera | E05B 47/0012 |
| 9,619,953 | B2 * | 4/2017 | Ranchod | G07C 9/00182 |
| 2009/0299777 | A1 | 12/2009 | Silberman | |
| 2010/0300163 | A1 | 12/2010 | Loughlin et al. | |
| 2013/0255335 | A1 | 10/2013 | Jonely | |
| 2014/0250954 | A1 | 9/2014 | Buzhardt | |
| 2015/0292244 | A1 * | 10/2015 | Beatty | E05B 47/0012 70/20 |
| 2017/0009491 | A1 * | 1/2017 | Nguyen | E05B 67/10 |

FOREIGN PATENT DOCUMENTS

| | | |
|---|---|---|
| GB | 2182975 | 5/1987 |
| KR | 20080001597 | 6/2008 |
| WO | 2013049533 | 4/2013 |

OTHER PUBLICATIONS

CodeLocks Americas CL2200 Electronic Surface Deadbolt, http://www.codelocks.us/cl2000/cl2200-electronic-surface-deadbolt.html, printed Oct. 30, 2015 (2 pages).
Kwikset Electronic Locks Keyless Entry & Combination Deadbolts, http://www.kwikset.com/smartsecurity/electronic-locks.aspx, printed Oct. 30, 2015 (2 pages).
1500eXD/1500eXDPNK dialSpeed Instructions, www.masterlock.com (1 page).
KitLock Coded Locker Solutions KL1200 (1 page).
International Search Report dated Feb. 7, 2017 in international patent application No. PCT/CN2016/108711 (8 pages).
International Search Report dated Jun. 8, 2018 in international patent application No. PCT/CN2018/075587 (5 pages).

* cited by examiner

ELECTRONIC COMBINATION LOCK WITH DIFFERENT LEVELS OF ACCESS CONTROL

CROSS REFERENCE TO RELATED PATENT APPLICATION

This application claims priority under 35 USC § 119 to U.S. Provisional Patent Application No. 62/266,052, filed Dec. 11, 2015, whose entire contents are hereby incorporated by reference.

BACKGROUND OF THE INVENTION

In today's market, there are many electronic locking devices. Many of those locking devices require a user to use an electronic device to send an electronic signal for controlling the access of the locking device. In order to gain access of the locking device, the user must have such an electronic device. With an electronic combination lock, however, all a user needs is the combination code. The combination code can be shared with another person to allow that person to gain access to the electronic combination lock.

SUMMARY OF THE INVENTION

The present invention provides an electronic combination lock that can be unlocked by a combination code entry. According to some embodiments of the present invention, the access of combination lock can have different levels. For example, the homeowner can allow a temporary user to have limited access to the homeowner's property by issuing a temporary code. Once such temporary code has been used for the designated number of times, the code will become invalidated. The combination code can be entered using a touch panel on the combination lock or it can be entered by a detached electronic device. In some embodiments of the present invention, the combination lock has an overriding mechanism using a key to open the lock. Thus, the electronic combination lock, according embodiments of the present invention, comprise a shackle having a short leg and a long leg, a lock body comprising a long-leg channel dimensioned to receive the long leg of the shackle, the shackle locatable in a first shackle position in relationship to the lock body when the combination lock is operated at least in a locked mode and in a second shackle position when the combination lock is operated in an opened mode;

a locking mechanism configured to engage with the shackle for securing the shackle in the first shackle position when the combination lock is operated in the locked mode;

an electromechanical device coupled to the locking mechanism;

an electronic keypad configured to receive a combination code; and an electronic processor configured to control the electromechanical device based on the combination code, such that when the combination code matches a preset code, the locking mechanism is caused to disengage from the shackle, causing the combination lock to operate in an unlocked mode, wherein when the combination lock is operated in the unlocked mode, the shackle can be caused to change from the first shackle position to the second shackle position so as to operate the combination lock in the opened mode, and wherein the preset code is indicative of an access level of the combination lock, the access level comprising a first level, a second level and a third level, such that a combination lock user of the first level is allowed to change the preset code for the first level, the preset code for the second level and the preset code of the third level, whereas a combination lock user of the third level is prohibited from changing the preset code, and whether a combination lock user of the second level is allowed to change the preset code of the second level is pre-determined by the combination lock user of the first level, and wherein the electronic processor is configured to determine the access level based on the combination code.

According to an embodiment of the present invention, the electronic keypad further comprises a reset button configured to provide to the electronic processor an electronic signal indicative of a procedure to change the preset code.

According to an embodiment of the present invention, the combination lock user of the first level has unlimited number of access times to open the combination lock, whereas a combination lock user of the third level has a limited number of access times, and whether the combination user of the second level has unlimited number of access times or limited number of access times is determined by the combination lock user of the first level.

According to an embodiment of the present invention, the combination lock further comprises:

a cylinder, a rotatable cam coupled to the cylinder;

a fixed cam positioned in relationship to the rotatable cam for providing the locking hole; and a blocking plate movably attached to the rotatable cam, the blocking plate locatable in a first plate position for blocking the locking hole and in a second plate position for unblocking the locking hole, such that when the cylinder is caused to rotate by a matching key, the rotatable cam is configured to move the blocking plate from the first plate position to the second plate position so as to operate the combination lock in the unlocked mode.

According to an embodiment of the present invention, the combination lock further comprises:

an electronic signal receiver configured to receive an electronic signal indicative of the combination code and to provide the combination code to the electronic processor so as to allow the electronic processor to determine whether the combination code matches the preset code.

The present invention will become apparent upon reading the description taken in conjunction with FIGS. 1 to 32.

DESCRIPTION OF THE INVENTION

Figure 1:
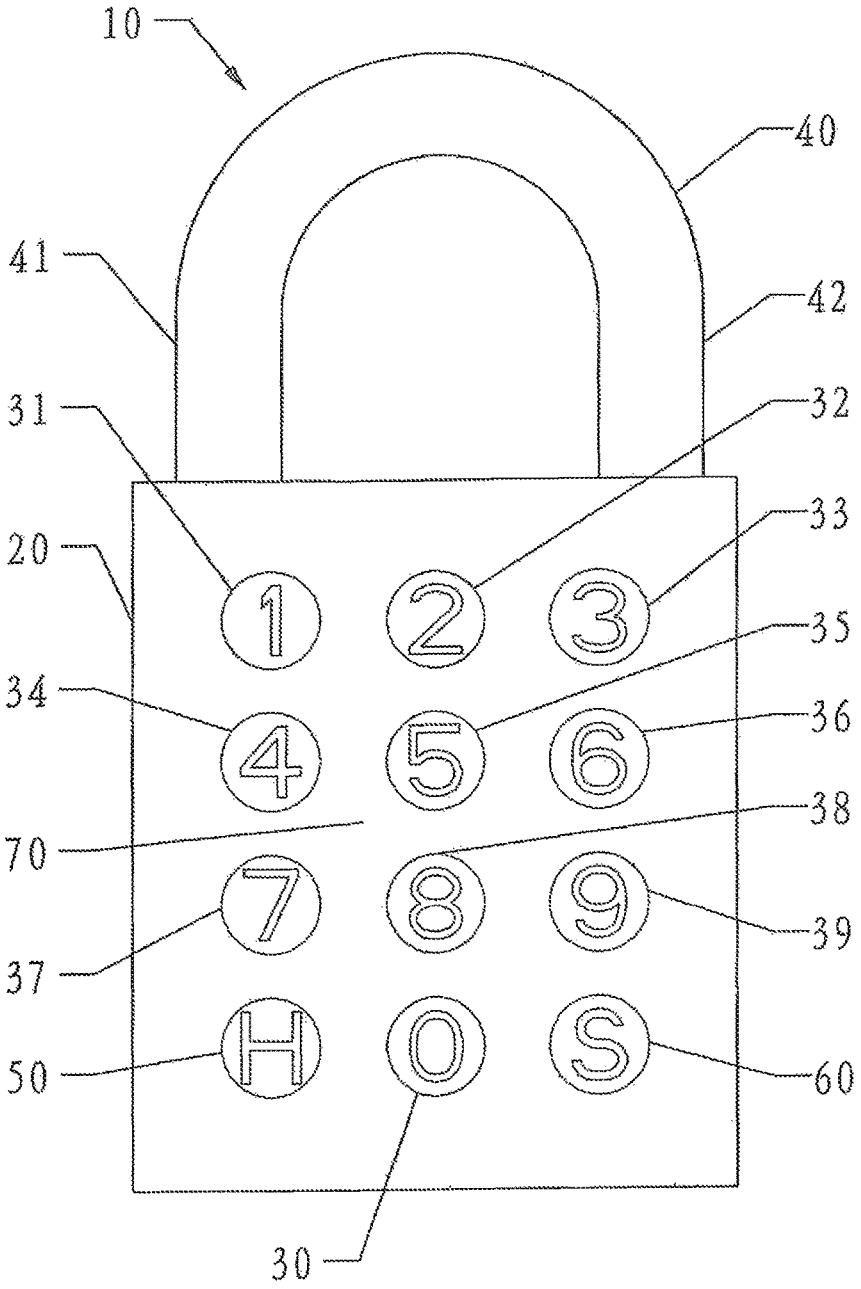
FIG. 1 shows an electronic combination lock, according to an embodiment of the present invention.
Figure 2:
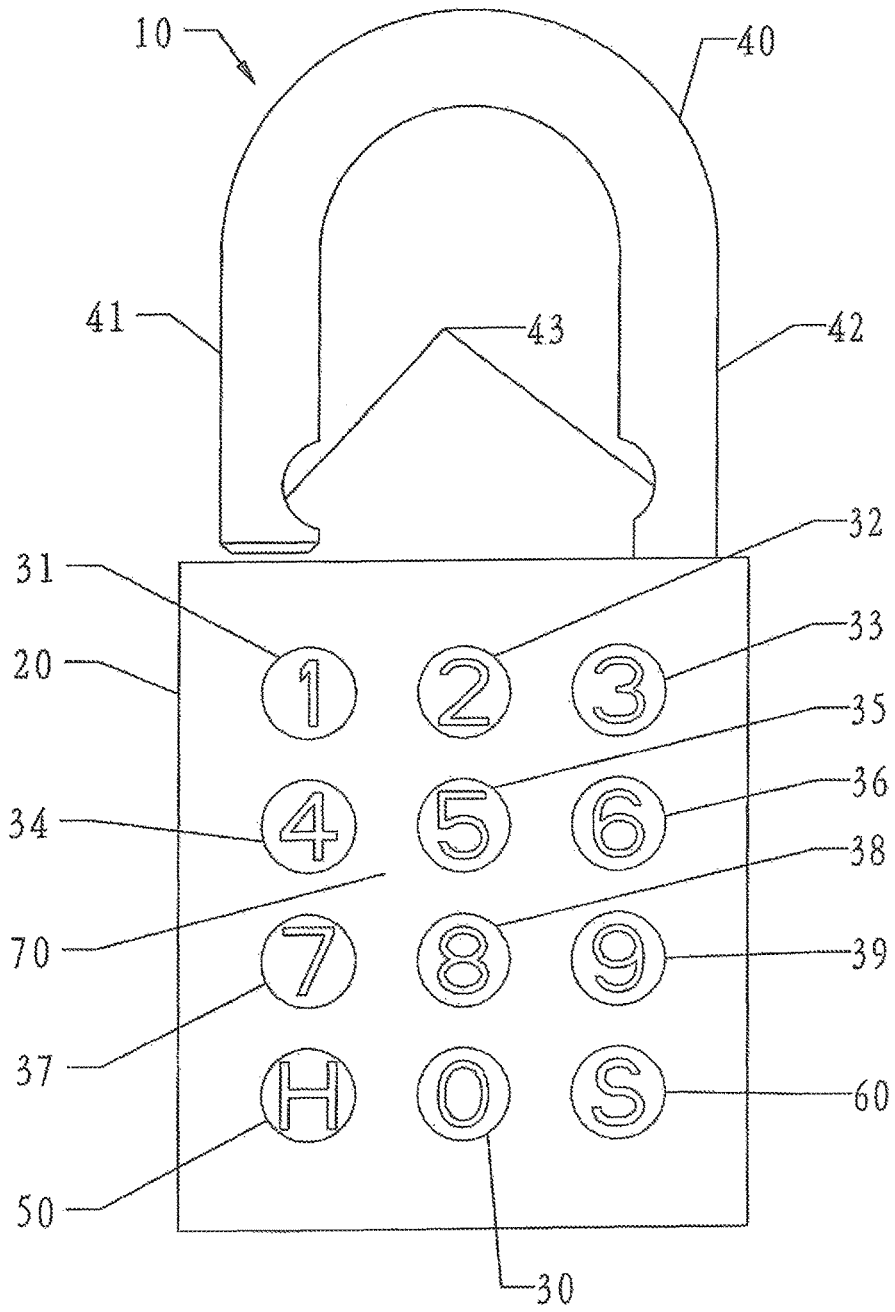
FIG. 2 shows the electronic combination lock in an opened mode as the shackle has been released.

As seen in FIGS. 1-13, the electronic combination lock 10, according to an embodiment of the present invention, has a lock body 20, a shackle 40 and a touch panel 70. The touch panel 70 has a plurality of numerical keys or keypads 30-39, a home button 50 and a reset button 60. The shackle 40 has a short leg 41 and a long leg 42. The lock body 20 has a lock hole 21 dimensioned to receive the short leg 41 and a long-leg channel 22 dimensioned to receive the long leg 42 of shackle 40. The long-leg channel 22 defines a longitudinal axis for rotation. Each of the short leg 41 and the long leg 42 has a cutout 43 as part of the locking mechanism. The locking mechanism includes a locking bolt 80 and a locking ball 180 engaging with the cutout 43 on the short leg 41 and the cutout 43 on the long leg 42 when the combination lock 10 is operated in the locked mode and in the unlocked mode (FIG. 1). The position of locking bolt 80 and locking ball 180 is controlled by a rotatable cam 140. The cam 140 has a bolt slot 144 and a bolt slot 145 positioned such that when the cam 140 is rotated by a certain angle, the locking bolt 80 and the locking ball 180 are allowed to move away from the cutouts 43. As such, the shackle 40 can be pushed upward by a shackle spring 160 to release the short leg 41 of shackle 40 from the lock hole 21 of lock body 20 to operate the combination lock in the opened mode (FIG. 2). The shackle 40 can now be rotated along the long leg 42 as a rotation axis. The cam 140 has a groove 146 (see FIG. 11B) with a groove indent 141 having an engaging relationship with a cam ball 90. The position of the cam ball 90 is controlled by a solenoid 100 having a slug or tip 101 (see FIG. 8). When the combination lock 10 is operated in the locked mode, the tip 101 or solenoid 100 is arranged to push the cam ball 90 against the groove intent 141 such that the cam 140 cannot be rotated to release the shackle 40 as illustrated in FIG. 3A.

Figure 3:
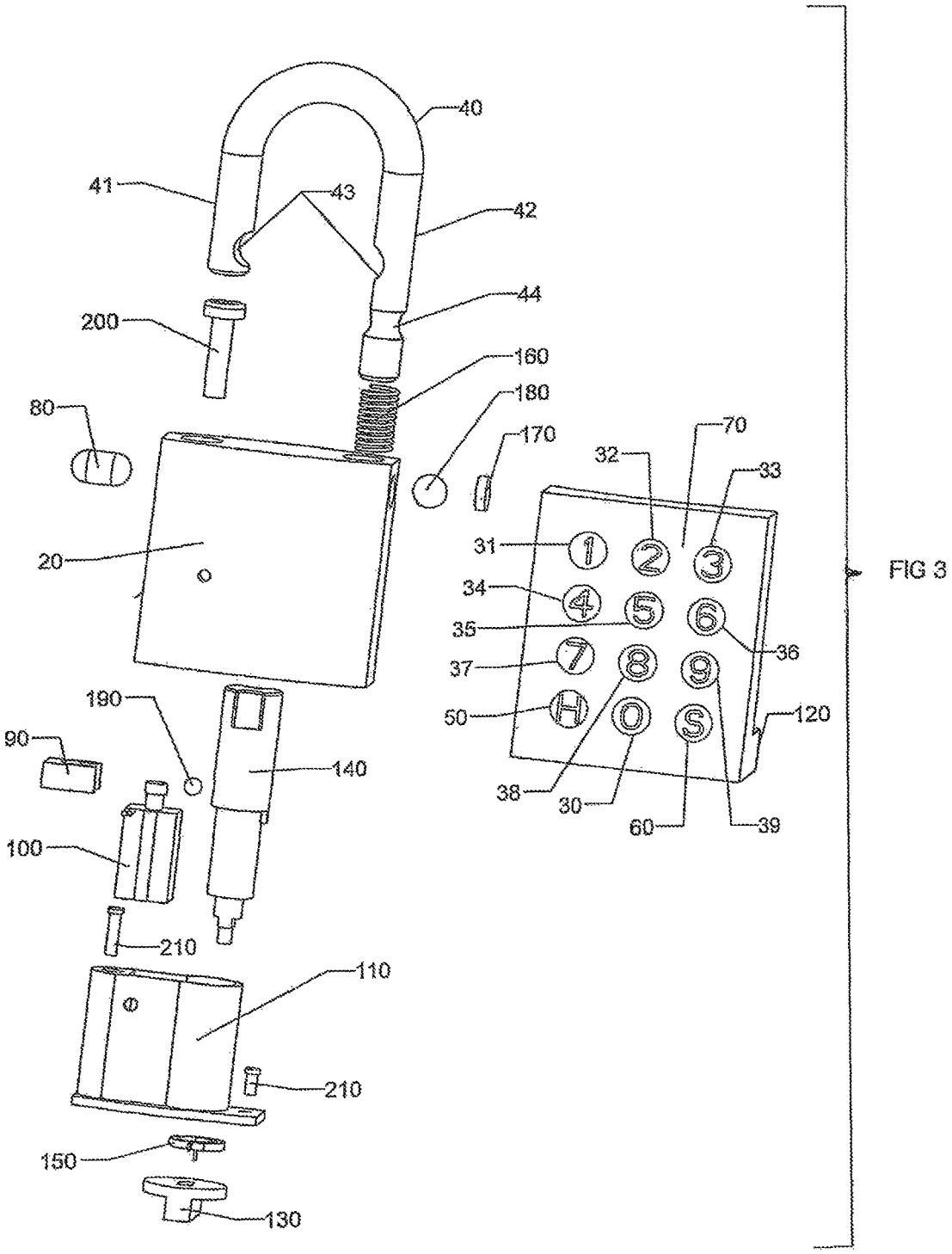
FIG. 3 is an exploded view of the combination lock showing various mechanical components of the lock.
Figure 3A:
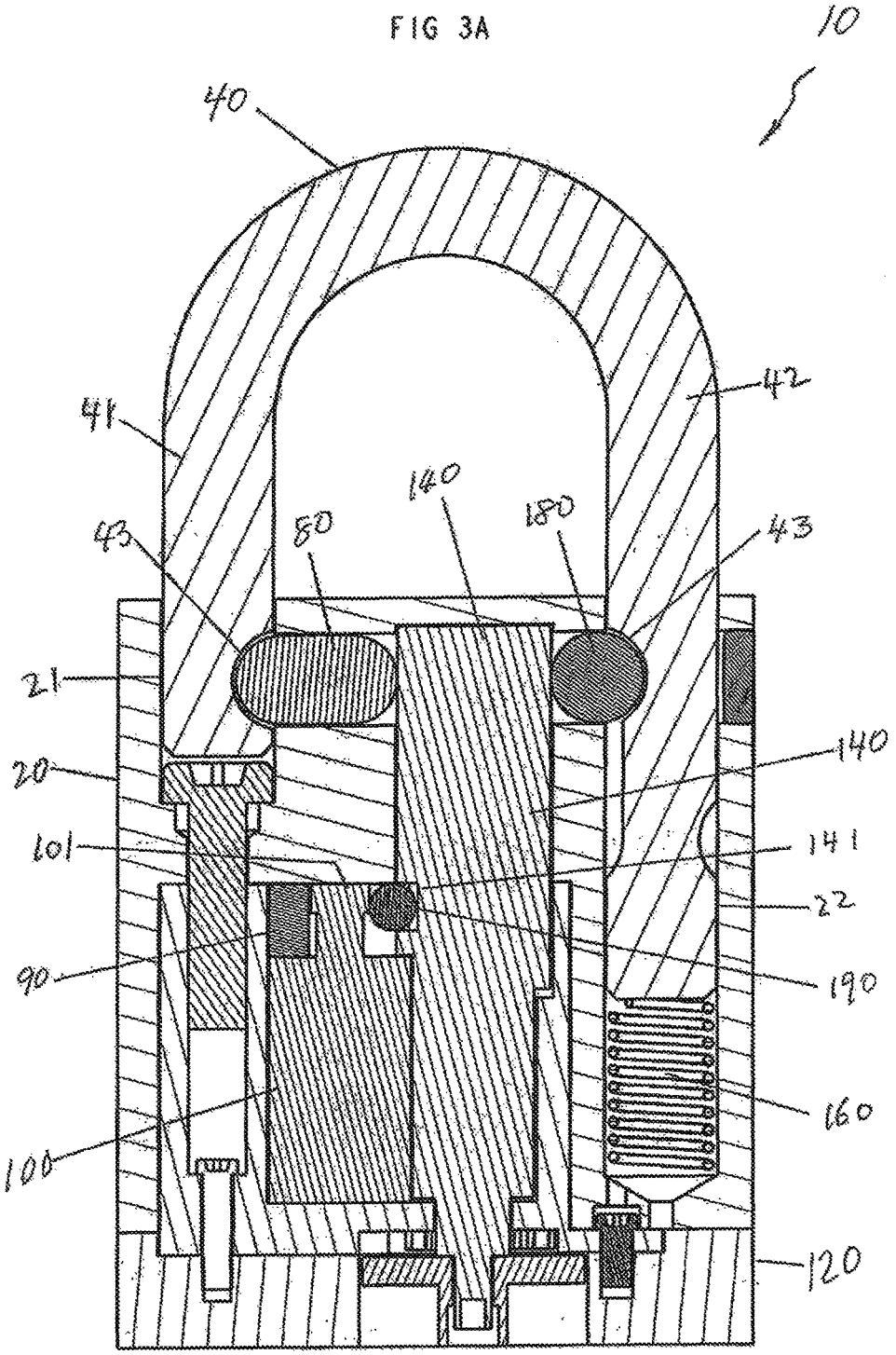
FIG. 3A is a cross sectional view of the combination lock in a locked mode.
Figure 3B:
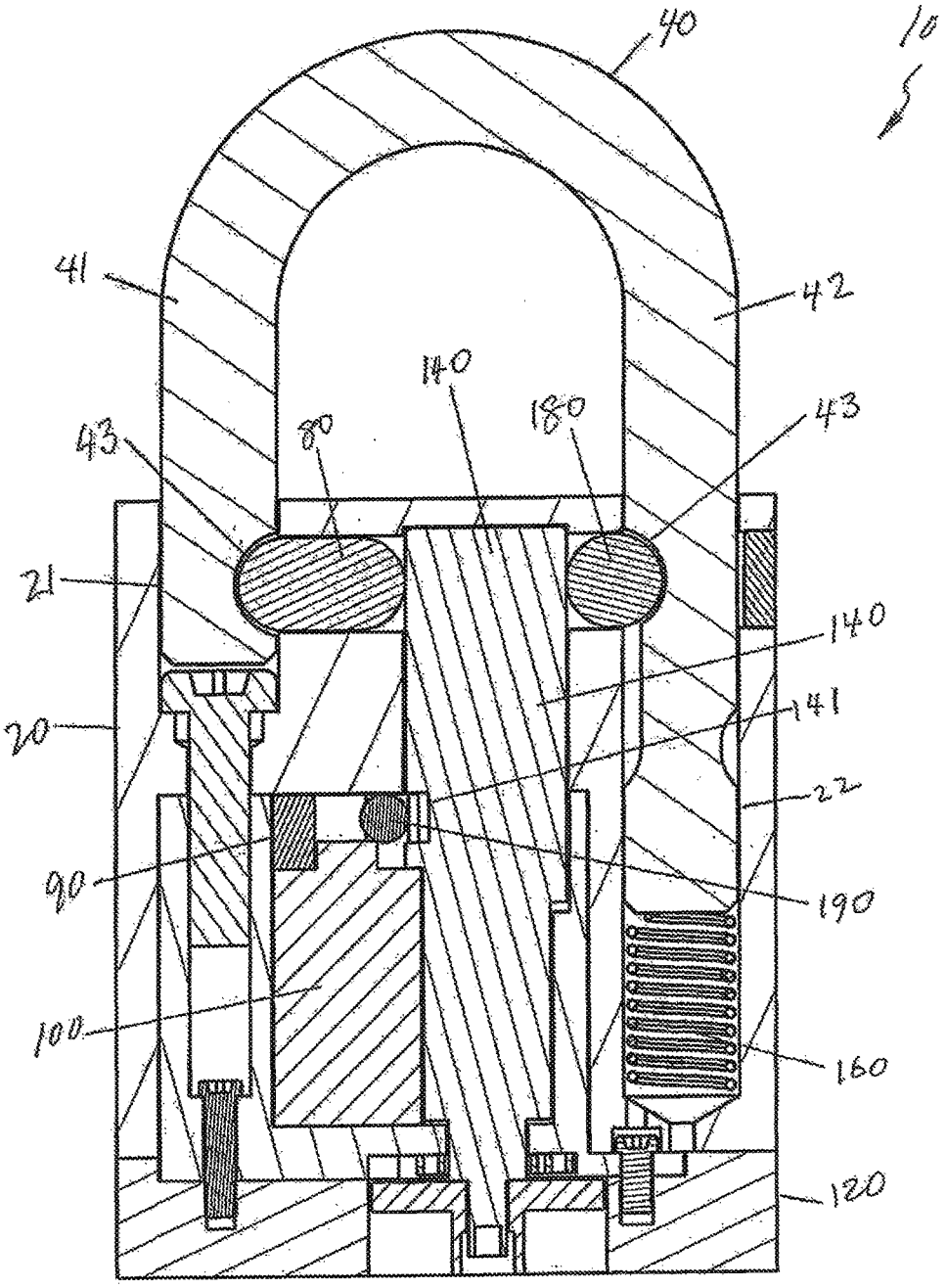
FIG. 3B is a cross sectional view of the combination lock in an unlocked mode.
Figure 4A:
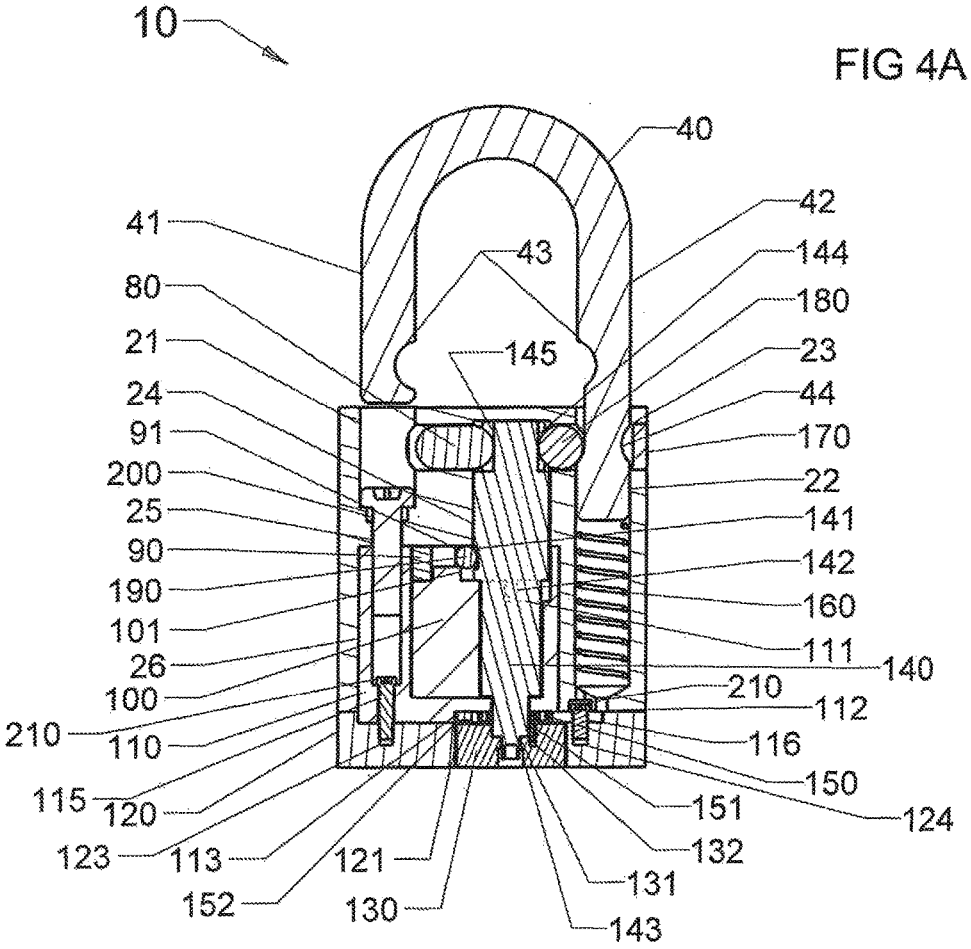
FIG. 4A is a cross sectional view of the combination lock in an opened mode.
Figure 4B:
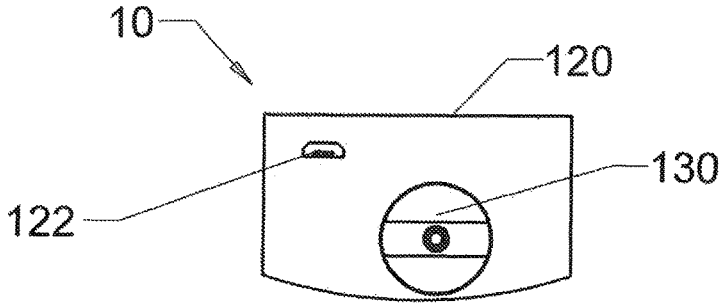
FIG. 4B is a bottom view of the combination lock.
Figure 12:
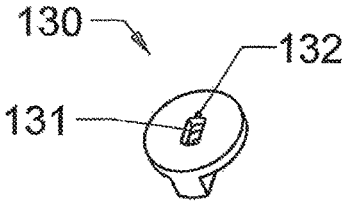
FIG. 12 shows a bottom view of the turn knob.

When a user uses the touch panel 70 to key in the correct combination code using keypads 30-39, the solenoid 100 is energized to cause the tip 101 to move inward toward the solenoid body 102 and the combination lock is in the unlocked mode as illustrated in FIG. 3B. As such, the cam ball 90 can move away from the groove indent 141, allowing the user to rotate the cam 140 to release the shackle 40 to operate the combination lock in the opened mode as illustrated in FIG. 4A. As seen in FIGS. 4A and 4B, the combination lock 10 has a panel base 120 connected to the lock body 20. The panel base 120 has a base support 128 connected to a panel support 129. The panel support 129 is arranged to support the touch panel 70. As seen in FIG. 12, the base support 128 has a base opening 121 to place a turn knob 130. The turn knob 130 has a slot 131 fixedly attached to flat surfaces 143 of the cam 140 such that when the cam ball 90 has moved away from the groove indent 141, the user can use the turn knob 130 to rotate the cam 140 to release the shackle 40 in order to operate the lock 10 in the opened mode.

It should be understood that some of the components of the electronic combination lock 10 are not shown in the drawings as shown in FIGS. 1-30. For example, the electronic combination lock 10 has a non-transitory memory unit to store combination codes; an electronic processor to determine whether a keypad entry by a user matches a stored combination code; an electronic driving circuit to drive the solenoid; a power source or battery to provide electrical power to various electronic and electro-mechanical components and a battery charger. These components are presented in the block diagram of FIG. 31. Furthermore, the touch panel 70 can be any type of touch panel or touchscreen. For illustration purposes only, in the touch panel 70 described herein, the numerical keypad with keys 30-39, the home button 50 and the set button 60 appears on the touch panel 70 only long enough for keypad entry. According to an embodiment of the present invention, the battery, the electronic processor and other electronic circuits are housed in the panel base 120, for example.

As seen in FIG. 4B which shows the bottom view of the combination lock 10, the panel base 120 has a charging slot 122 arranged for charging the battery in the panel base 120.

Figure 5:
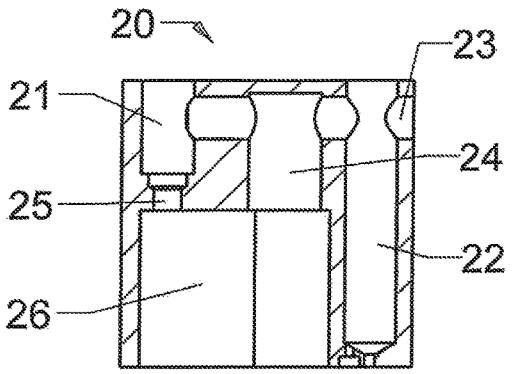
FIG. 5 is a cross sectional view of the lock body.

As seen in FIG. 5, the lock body 20 has a lock hole 21 dimensioned to receive the short leg 41 of shackle 40; a long-leg channel 22 dimensioned to receive a shackle spring 160 and the long leg 42 of shackle 40; a bolt hole 23 for placing the locking bolt 80 and the locking ball 180 inside the lock body 20; a cam hole 24 for placing the cam 140; an open area 26 to receive part of a solenoid base 110; and a screw hole 25 below the lock hole 21 to allow a screw 200 to fasten the lock body 20 to the solenoid base 110.

Figure 6:
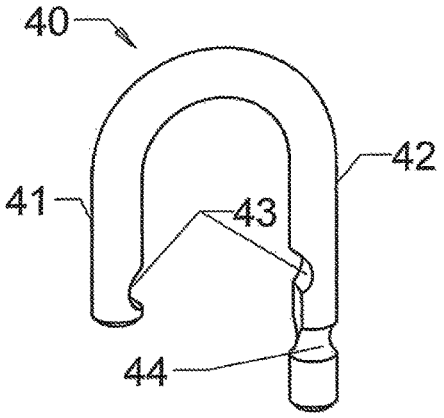
FIG. 6 is an isometric view of the shackle.

As seen in FIG. 6, the shackle 40 also has a retaining groove 44, together with the locking ball 180, arranged to prevent the long leg 42 of shackle 40 from completely moving away from the long-leg channel 22 of lock body 20.

Figure 11A:
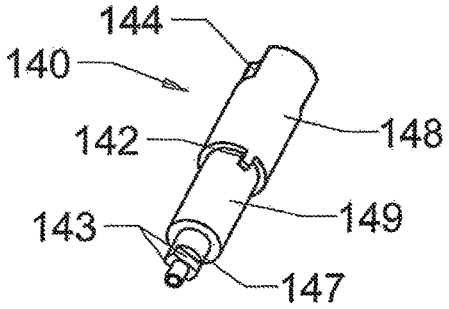
FIGS. 11A and 11B show different views of the cam.
Figure 11B:
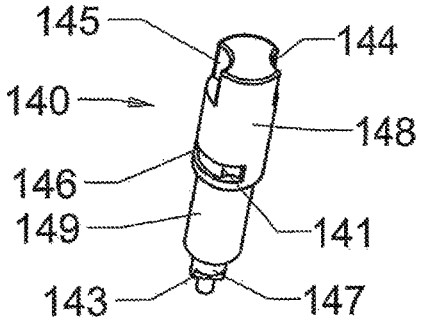

As seen in FIGS. 11A and 11B, the cam 140 has a larger cylindrical body 148 and a smaller cylindrical body 149. The upper part of the larger cylindrical body 148 has a bolt slot 144 and a ball slot 145. The lower part of the larger cylindrical body 148 has a fin 142 extended over the upper part of the smaller cylindrical body 149. The lower part of the smaller cylindrical body 149 has a reduced end 147 with two opposing flat surfaces 143. The lower part of the larger cylindrical body 148 also has a groove 146 and an indent 141 at one end of the groove 146. The groove 146 is used to keep the cam ball 90 on track while the cam 140 is rotated.

Figure 9A:
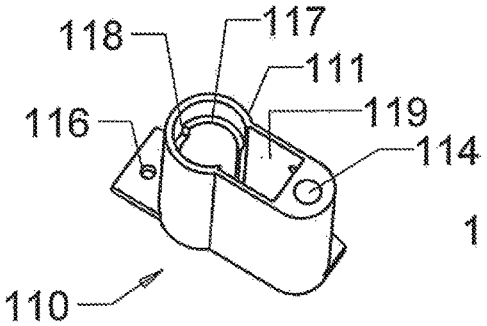
FIG. 9A shows a top view of the solenoid base.

As seen in FIG. 9A, the solenoid base 110 has an outer cylindrical wall 111 and an inner cylindrical wall 117. The an inner diameter of outer cylindrical wall 111 is dimensioned to receive the large cylindrical body 148 of cam 140, whereas the inner diameter of the inner cylindrical wall 117 is dimensioned to receive the smaller cylindrical body 149 of cam 140. The inner wall 117 has an edge 118 arranged to stop the fin 142 of cam 140 in order to limit the rotation of cam 140. The solenoid base 110 also has an opening 119 dimensioned to receive the solenoid 100.

Figure 9B:
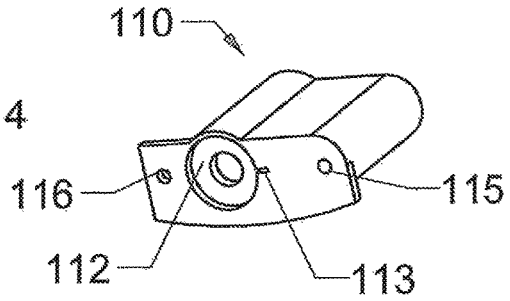
FIG. 9B shows a bottom view of the solenoid base.
Figure 13:
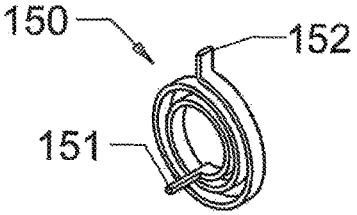
FIG. 13 is an isometric view of the cam spring.
Figure 14A:
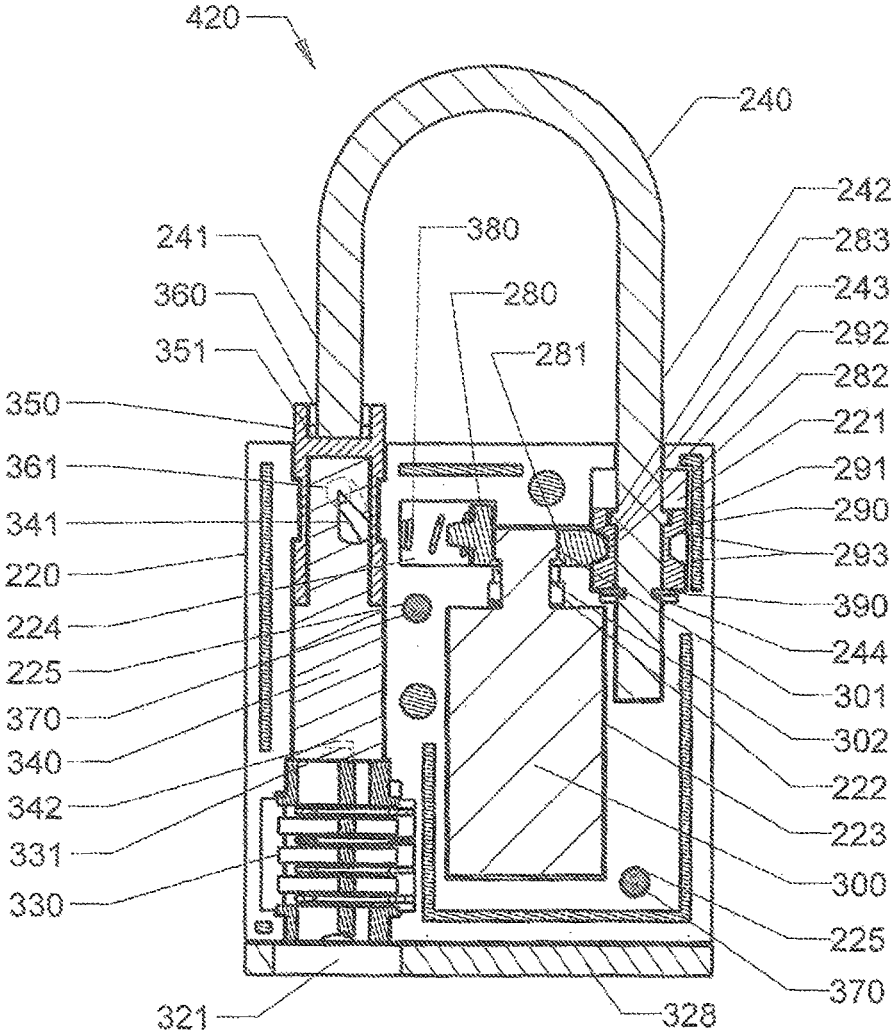
FIG. 14A is a cross sectional view of the combination lock in a locked mode, according to a different embodiment of the present invention.
Figure 14B:
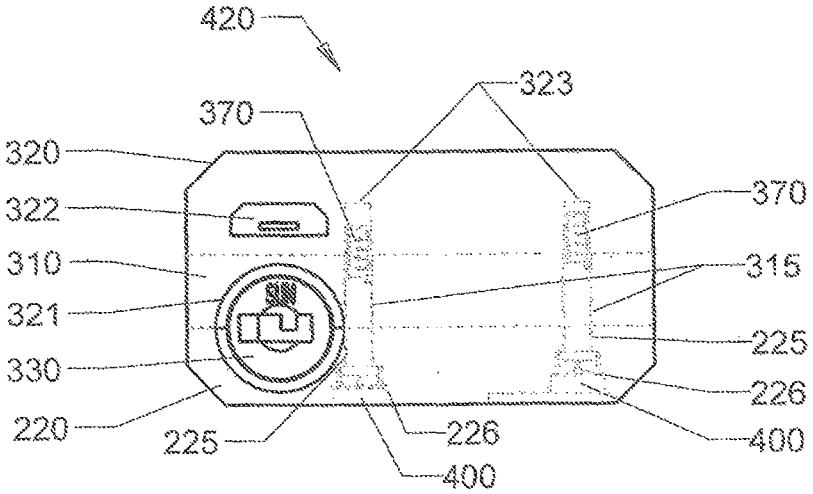
FIG. 14B is a bottom view of the combination lock of FIG. 14A.
Figure 15:
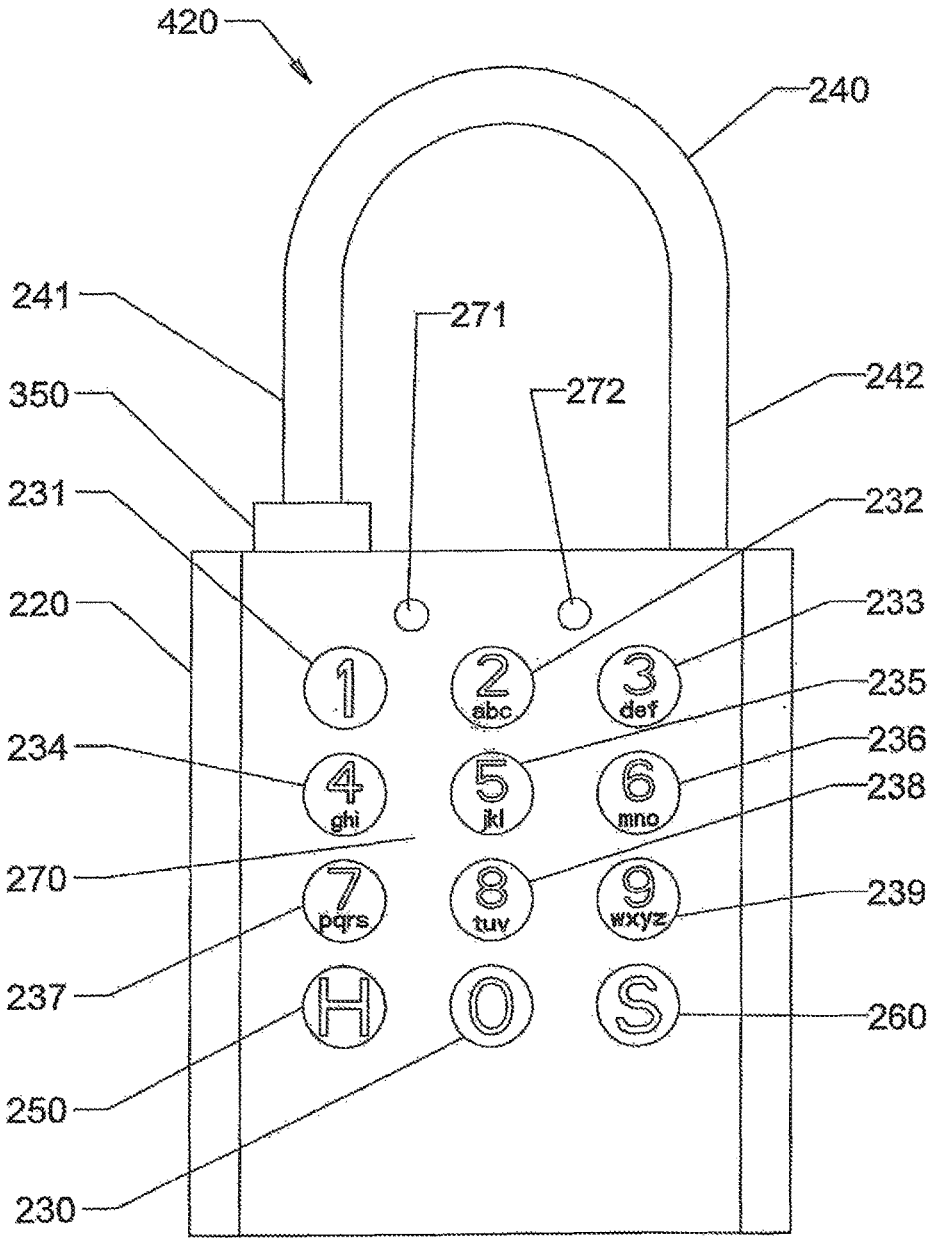
FIG. 15 is a front view of the combination lock of FIG. 14A.

As seen in FIGS. 9B and 13, the solenoid base 110 has a base recess 112 to receive a cam spring 150 which has a knob-side tail 151 and a base-side tail 152. In the periphery of the base recess 112 there is a slot 113 arranged to receive the base-side tail 152 of cam spring 150.

Figure 7:
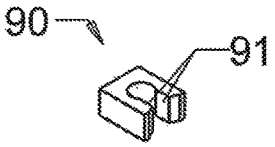
FIG. 7 is an isometric view of the solenoid-tip guide slot.
Figure 8:
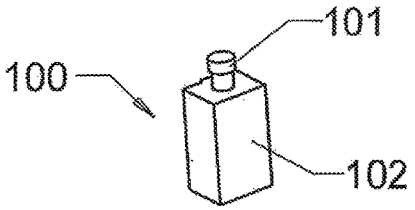
FIG. 8 shows an example of a solenoid.

FIG. 7 shows a solenoid-tip guide 90 positioned on top of solenoid 100. The solenoid-tip guide 90 has an opening 91 dimensioned to receive tip 101 of solenoid 100. The placement of the solenoid guiding unit 90 limits the lateral movement of the cam ball 190 when the tip 101 of solenoid 100 is retrieved inward toward the solenoid body 102 to allow lock 10 to operate in the opened mode.

Figure 10A:
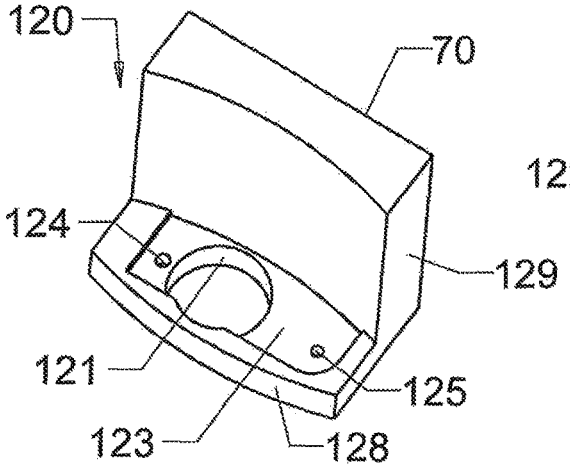
FIG. 10A shows a top view of the panel base.
Figure 10B:
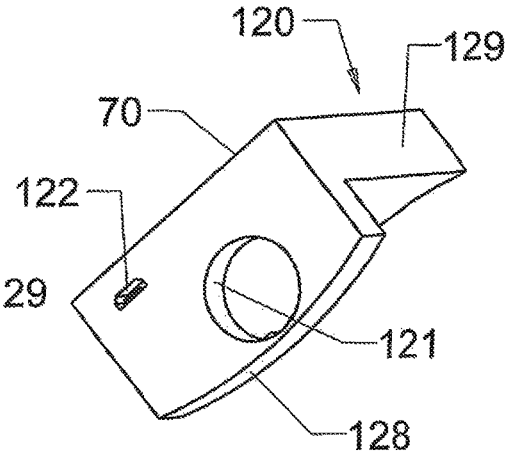
FIG. 10B shows a bottom view of the panel base.

FIGS. 10A and 10B show different views of the panel base 120 which has a panel support 129 attached a base support 128. The panel support 128 is arranged to mount a touch panel 170. As seen in FIG. 10A, the base support 128 has a recessed area 123 dimensioned to receive the base of the solenoid base 110. In the recessed area 123 there are two screw holes 124, 125 arranged for fastening the solenoid base 110 to the panel base 120 with screws 210 (see FIG. 4A). With the solenoid base 110 securely fastened to the panel base 120, the solenoid base 110 can be inserted into the open area 26 of lock body 20 with the lock body 20 located next to panel support 129.

It should be understood that the electrical power provided to the solenoid 100 can be made through electrical contacts in the solenoid base 110 and the panel base 120, for example. The electrical power provided to the touch panel 70, the electronic processor and other electronic circuit components can be made through electrical connectors in the panel base 120, for example. A power source such as a rechargeable battery required for powering the electronic and electromechanical components of the electronic combination lock 10 can be recharged through the charging slot 122 on the panel base 120.

Classification of Users

The electronic combination lock 10, according to an embodiment of the present invention, can be used by a number of users with different access levels. For example, there can be three access levels and the combination lock users can be classified as master users, regular users and temporary users, associated with different combination codes. According to an embodiment of the present invention, the master users have the highest level of access; the regular users have a second level of access and the temporary users have a third level of access.

As disclosed herein, the terms "permanent user" and "regular user" are used interchangeably.

Master User

There can be one master code or more than one master code. A user with a master code has an unlimited number of access times (that is, an unlimited number of times to unlock the lock) and can use the reset mode 1) to change the master code, 2) to change or disable a temporary code or a permanent code; and 3) to assign the number of access times for the temporary code user.

Permanent or Regular User

There can be one or more permanent or regular codes. A user with a permanent code has an unlimited number of access times. However, the permanent users cannot use the reset mode, according to one embodiment of the present invention. In another embodiment of the present invention, a permanent code user is allowed to use the reset mode but only to change his/her own code.

Temporary User

There can be one or more temporary codes. A user with a temporary code has a limited number of access times. A temporary user is not allowed to use the reset mode.

According to an embodiment of the present invention, the use of a code to operate the padlock is described as follows:

Unlocking Procedure by any User (Master User, Permanent User or Temporary User, with a Valid User Code as Validated by a Code Storage in the Padlock)

1. Touch anywhere on the screen to cause the keypad to appear on the screen.
2. On the keypad, enter a combination code and then press the home-key to set the padlock in the unlocked mode.
3. Manually release the shackle in order to mechanically open the padlock.

In one embodiment, the shackle must be manually released within a predetermined period of time. When the predetermined period of time has expired, the padlock automatically returns to the locked state. If the user wants to open the lock again, the user can follow the same procedure.

For demonstration purposes, assuming the padlock is configured to store a total of 9 users. User 1 has the master code, and Users 2-6 are regular users which can have unlimited number of access times. Users 7-9 are temporary users having only a limited number of access times to use a code to access to the lock.

Reset Procedure for Resetting a Master Code (the User Must have a Master Code as Validated by the Code Storage in the Padlock)

1. Touch anywhere on the screen to cause the keypad to appear on the screen.
2. On the keypad, enter a master code and then press the home-key to set the padlock in the unlocked mode.
3. Press the set button and then the home-key to enter the "reset mode"
4. Enter the same master code the then press the home-key (optional in one embodiment).
5. Press 1 to select the type of code to be changed.

6. Enter a new (master) code and then press the home-key to set the padlock in the lock mode.

Reset Procedure for Resetting a Permanent Code (the User Must have a Master Code as Validated by the Code Storage in the Padlock)

1. Touch anywhere on the screen to cause the keypad to appear on the screen.
2. On the keypad, enter a master code and then press the home-key to set the padlock in the unlocked mode.
3. Press the set button and then the home-key to enter the "reset mode".
4. Enter the same master code and then press the home-key (optional in one embodiment)
5. Press 2-6 to select the type of code to be changed.
6. Enter a new (permanent) code and then press the home-key to set the padlock in the lock mode.

Reset Procedure for Resetting a Temporary Code (the User Must have a Master Code as Validated by the Code Storage in the Padlock)

1. Touch anywhere on the screen to cause the keypad to appear on the screen.
2. On the keypad, enter a master code and then press the home-key to set the padlock in the unlocked mode.
3. Press the set button and then the home-key to enter the "reset mode".
4. Enter the same master code and then press the home-key (optional in one embodiment).
5. Press 7-9 to select the type of code to be changed.
6. Enter a new (permanent) code and then press the home-key.
7. Enter a number between 1 and 9 to set the number of access times and then press the home-key to set the padlock in the locked mode.

Reset Procedure for Resetting a Permanent Code by the Permanent User (the User Must have a Permanent Code as Validated by the Code Storage in the Padlock)

1. Touch anywhere on the screen to cause the keypad to appear on the screen.
2. On the keypad, enter a master code and then press the home-key to set the padlock in the unlock mode.
3. Press the set button and then the home-key to enter the "reset mode".
4. Enter the same permanent code and then press the home-key (optional in one embodiment).
5. Enter a new (permanent) code and then press the home-key to set the padlock in the lock mode.

Unlocking and Locking the Combination Lock

When the user wants to operate the electronic combination lock 10 in the opened mode, the user can touch the panel 70 to cause the keypads 30-39, home button 50, and set button 60 to be displayed on the panel. The user can type in a predetermined combination code and then press the home button 50. The electrical power is transferred to the solenoid 100 in a short period of time, about 10 seconds, for example. As the solenoid 100 is activated, the tip 101 of the solenoid 100 moves downward toward the solenoid body 102. As the tip 101 of the solenoid 100 moves downward, the cam ball 190 is able to move away from the groove indent 141 in groove 146 of cam 140. Because the cam 140 is fixedly attached to the turn knob 130, the cam 140 can be rotated by turning the turn knob 130 in order to release the shackle 40. As the cam 140 turns away from its locking position, the locking bolt 80 and locking ball 180 can move into the bolt slot 144 and the ball slot 145. As such, the locking bolt 80 and locking ball 180 are disengaged from the cutouts 43 on the short leg 41 and the long leg 42 of shackle 40. The shackle 40 is now allowed to move upward under the urging force of the shackle spring 160 to release the short leg 41 from the lock hole 21 of lock body 20.

According to some embodiments of the present invention, after the user keys in the correct combination code, there is a period of 10 seconds or so to allow the solenoid to acquire sufficient electrical power in order to attract the tip 101 of solenoid 100 into the downward position. The cam ball 190 is now allowed to move away from the groove 141 indent of cam 140 and the user can now turn the turn knob 130 and the cam 140 to open the lock. With the urge of the shackle spring 160, the shackle 40 moves upward until the locking ball 180 moves into the retaining groove 44 of shackle 40. The groove 44 is arranged to prevent the long leg 42 of shackle 40 from completely moving away from the long-leg channel 22 of lock body 20. After about 10 seconds, the electrical power to the solenoid 100 can be cut off so as to allow the tip 101 of solenoid 100 to move upward. It should be noted that, although the lock 10 is in the opened position, the cam ball 190 is still located on the track 146 of cam 140.

To return the lock 10 to the locked mode, the user simply pushes the shackle 40 downward and the cam 140 is caused to rotate back to its locking position by a cam spring 150 which has a knob-side tail 151 lodged in the spring-tail slot 132 on turn knob 130 and a base-side tail 152 lodged in the spring-tail slot 113 on solenoid base 110 (see FIG. 12). The locking bolt 80 and the locking ball 180 are pushed by the cam 140 into the cutouts 43 of the shackle 40. The cam ball 190 is also caused to move back to the groove indent 141 of cam 140, preventing the cam 140 from rotation relative to the lock body 20.

The solenoid base 110 has a threaded-hole 114 which allows a screw 200 to be fastened through the hole 25 on lock body 20. Once the screw 200 is fastened, the solenoid base 110 cannot be removed from the lock 10. The panel base 120 has two screws holes 124 and 125 which allow screws 210 to be fastened via holes 115 and 116 on solenoid base 110. As such, the solenoid-base 110 and the panel-base 120 are securely fastened to the lock body 20. The panel base 120 also has an opening 121 to allow the user to touch the knob 130. The panel base 120 also has a charging slot 122 to allow the user to charge the battery embedded in the panel base 120 if needed.

As seen in FIG. 3, the combination lock 10 has a sealing plug 170 dimensioned for insertion into the lock body 20 to conceal the bolt hole 23 of the lock body 20.

User Instruction to Unlock the Padlock

1. Touch the panel.
2. Key in a combination code (or old master code, or any preset User Code) and then press the home key.
3. Turn knob clockwise to release the shackle.
4. To lock the lock, simply push the shackle back to the lock position and the lock will lock itself automatically.

Resetting Master Code for USER 1 (Master User Reset Mode)

When the user wants to set a new Master code for the electronic combination padlock 10, the user can touch the touch panel 70 to cause the keypads 30-39, the home button 50, and the set button 60 to display on the panel. The user can now input a preset combination code (or existing Master code) and press the home key 50. The user can then press the set button 60 and then press the home key 50 again. The user can then press digit 1 (keypad 31) in order to set a new master code. After inputting the new master code by pressing numerical keys 30-39, the user must press the home button 50. The lock can now be unlocked with the new master code which must have at least 4 digits but can have 15 digits.

Resetting Permanent User Code for USERS 2-6 with Unlimited Access Time (Permanent User Reset Mode)

When the Master user wants to set a permanent code for the electronic combination padlock 10, the user can touch the touch panel 70 to cause the keypads 30-39, the home button 50, and the set button 60 to display on the panel. The user can input a preset combination code (or existing Master code) and press the home button 50. The user can then press the set button 60 and then the home button 50 again. The user can press one of digits 2-6 (keypads 32-36) in order to set the user code for the selected user among users 2-6. After inputting the new user code for the selected user by pressing numeral keys 30-39, the user must press the home key 50. The lock can now be unlocked with the new permanent user code which must have at least 4 digits but can have 15 digits.

Reset Temporary User Code for USERS 7-9 with Limited Access Time (Temporary User Reset Mode)

When the Master user wants to set the temporary code for the electronic combination padlock 10, the user can touch the panel 70 to cause the keypads 30-39, the home button 50 and the set button 60 to display on the panel. The user can input a preset combination code (or existing Master code) and press the home button 50. The user can then press the set button 60 and then the home button 50 again. The user can press one of the numerical keys 7-9 (keypads 37-39) in order to set the temporary user code for the selected user among users 7-9. After inputting the new user code for the selected user by pressing numeral keys 30-39, the user must press the home button 50. The new temporary user code must have at least 4 digits but can have 15 digits. The user can select the number 1-9 (31-39) for the number of access times that can be used with this temporary code and then the home button 50. Typically, the access times for the temporary code can range from 1-9. The lock is now set with the temporary user code for a temporary user.

Alternative Embodiment

According to a different embodiment of the present invention, the electronic combination lock includes an overriding key locking mechanism as disclosed in U.S. Pat. No. 7,140,209, which is assigned to The Sun Lock Company, Ltd., the assignee of the current application, and hereby incorporated by reference in its entirety.

Figure 22:
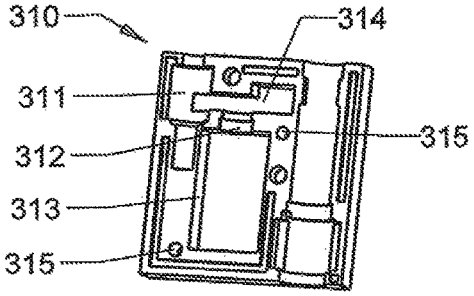
FIG. 22 shows a cross sectional view of a second half of the lock body.
Figure 23A:
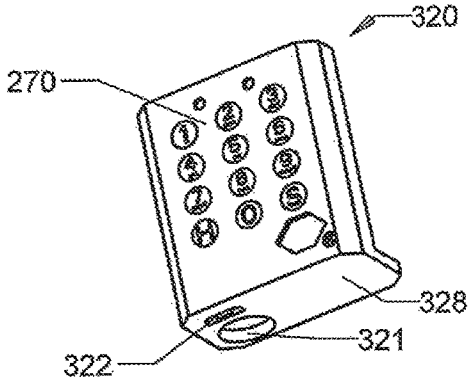
FIGS. 23A and 23B show different view of a panel base.
Figure 23B:
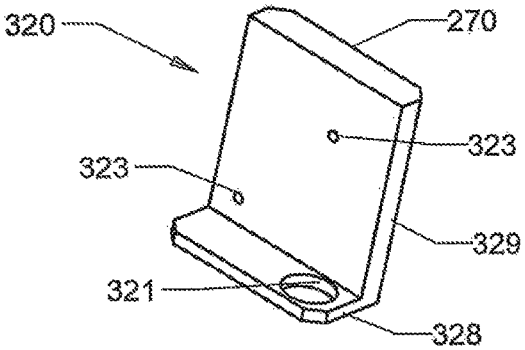
Figure 24:
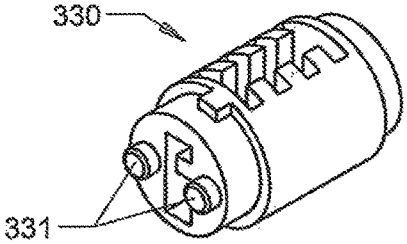
FIG. 24 is an isometric view of the cylinder.
Figure 25:
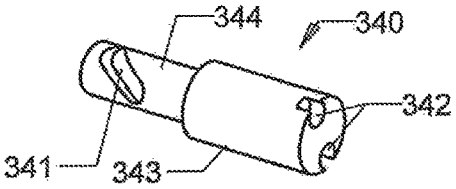
FIG. 25 is an isometric view of the cam.
Figure 26:
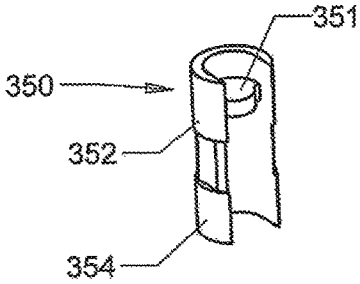
FIG. 26 is an isometric view of the fixed cam.
Figure 27:
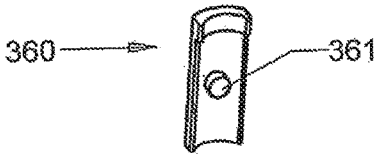
FIG. 27 shows a view of the blocking plate.
Figure 28:
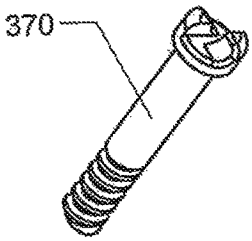
FIG. 28 shows a view of a screw.

As seen in FIGS. 14A-30, the electronic combination lock 420 has a lock body 220/310, a shackle 240 and a touch panel 270. The touch panel 270 has a plurality of numerical keys or keypads 230-239, a home button 250 and a reset button 260. The shackle 240 has a short leg 241 and a long leg 242 with a protrusion 243 and a neck 244. The touch panel 270 has a green light 271 and a red light 272. The green light 271 is lit to indicate the input code is correct and the red light 272 is lit to indicate otherwise. As seen in FIGS. 17A and 22, the lock body 220/310 has a lock-ring cutout 221/231 to accommodate a lock ring 290; a solenoid-tip cutout 222/312 dimensioned to receive the tip 301 of a solenoid 300 (see FIG. 21); a solenoid-body cutout 223/313 dimensioned to accommodate the solenoid body 303 of solenoid 300, and a latch cutout 224/314 to house a latch 280. The lock body 220/310 also has screw holes 225/315 to receive screws 270 and two holes 226 to receive screw caps 400 to conceal the screws 370 (see FIG. 14B). The lock body 220/310 has a cam channel 227 for accommodating a rotatable cam 340, a fixed cam 350 and a blocking plate 360. The lock body 220/310 also has a cylinder cutout 228 for placing a cylinder 330 and a long-leg channel 229 dimensioned to receive the end of the long leg 242 of shackle 240. The cylinder 330 has two cylinder pins 331. The rotatable cam 340 has a larger cylindrical body 343 and a smaller body 344. The end of the larger cylindrical body 343 has two receiving slots 342 dimensioned to receive the cylinder pin 331 of cylinder 330. The smaller cylindrical body 344 has a cam slot 341. The latch 280 has a latch hole 281 dimensioned to receive the tip 301 of solenoid 300, and a latch fork 282 arranged to engage with the ring groove 292 of a locking ring 290 which has two groove slopes 293 near the ring groove 292. The latch 280 also has a fork slope 283 on the latch fork 282 arranged to contact with the groove slopes 293 of locking ring 290. The combination lock 420 also has a panel base 320 with a base support 328 and a panel support 329 to support the touch panel 270 (see FIGS. 23A and 23B). The panel base 320 also has screw holes 323 to receive screws 370 for fastening the lock body 222/312 to the panel support 329 on top of the base support 328. The base support 328 has an opening 321 to allow a key 410 to be inserted into the cylinder 330 and a charging slot 322. The fixed cam 350 has a locking hole 351 arranged to receive the short leg 241 of shackle 240. The fixed cam 350 has a gap 355 sufficiently wide to allow the short leg 241 of shackle 240 to move out of the locking hole 351 through the gap 355. The blocking plate 360 is positioned adjacent to the gap 355 of fixed cam 350 and has a width sufficient to block the locking hole 351 so as to prevent the short leg 241 from moving out of the locking hole 351 through the gap 355 while the short leg 241 is located in the locking hole 351. The blocking plate 360 has a locking pin 361 movably engaged with the cam slot 341 of rotatable cam 340.

Locked Mode

As seen in FIGS. 14A, 15, 18, 19, 20A and 20B, the shackle 240 has a short leg 241, a long leg 242, a protrusion 243 and a neck 244. The locking ring 290 has a ring channel 294 dimensioned to receive the long leg 242 of shackle 240 such that the protrusion 243 of shackle 240 is placed on enlarged inner edge 291 of locking ring 20 with a C-clip 390 inserted in the neck 244 of shackle 240. As such, the long leg 242 can only have a rotational movement relative to the locking ring 290. When the lock 420 is operated in the locked mode, the tip 301 of solenoid 300 causes the latch fork 282 to engage with the ring groove 292 of locking ring 290, preventing the shackle 240 from moving upward relative to the lock body 220. With the solenoid 300 being inactive (not energized), the tip 301 is pushed upward by a solenoid spring 302, with the tip 301 of solenoid 300 engaged in the latch hole 281 of latch 280. In this arrangement, the shackle cannot be pulled upward to open the lock.

Furthermore, the fixed cam 350 is fixedly attached to lock body 220/310. The fixed cam 350 has a locking hole 351 arranged to receive the short leg 241 of shackle 240. The fixed cam 350 is not an enclosed cylinder such that the short leg 241 can be swung out of locking hole 351 while the long leg 242 remains in the downward position. However, in the locked mode, the blocking plate 360 is positioned relative to the fixed cam 350 to prevent it from being swung out of the locking hole 350.

The Key-Lock Mechanism

As seen in FIGS. 14A, 16, 24, 25, 26, 27 and 30, the cylinder pins 331 of cylinder 330 are inserted into the receiving slots 342 at the end of the larger cylindrical body 343 of rotatable cam 340 so that the cylinder 330 and the rotatable cam 340 can only rotate together by a key. The smaller cylindrical body 344 of rotatable cam 340 has a cam slot 341 to receive the locking pin 361 of blocking plate 360. If an incorrect key is used to unlock the padlock 420, the cylinder 330 and the rotatable cam 340 cannot be rotated. As the locking pin 361 of blocking plate 360 is engaged in the cam slot 341 of rotatable cam 340, the blocking plate 360 cannot move downward. As such, the short leg 241 of shackle 240 is prevented from being swung out of the locking hole 351 of fixed cam 350.

Figure 16:
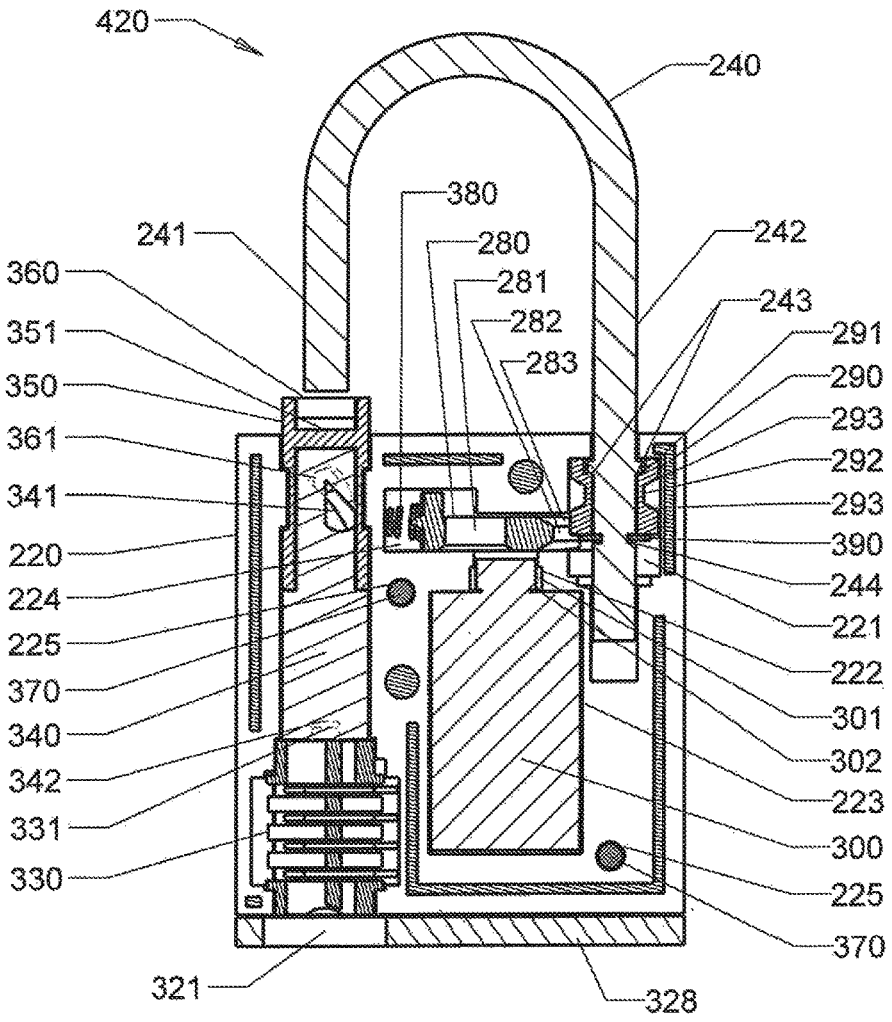
FIG. 16 is a cross sectional view of the combination lock of FIG. 14A when the lock is operated in an opened mode.
Figure 17A:
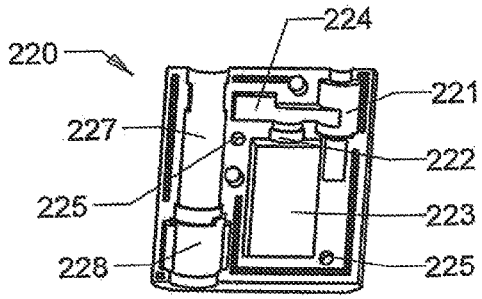
FIGS. 17A and 17B show different views of a first half of the lock body.
Figure 17B:
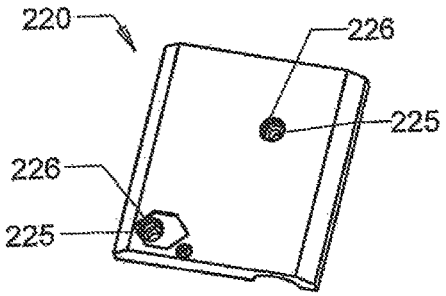
Figure 18:
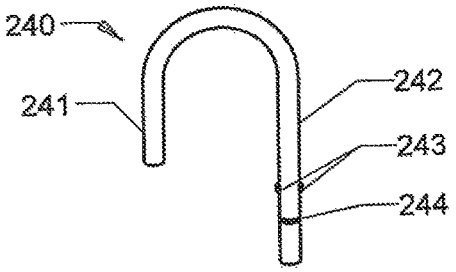
FIG. 18 is an isometric view of the shackle.
Figure 19A:
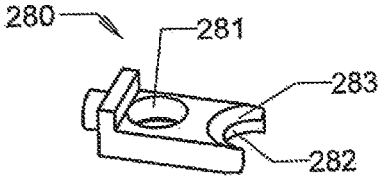
FIGS. 19A and 19B show different views of the latch.
Figure 19B:
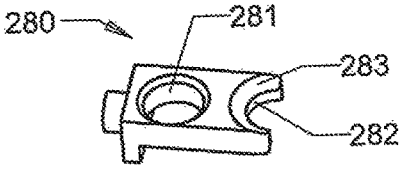
Figure 20A:
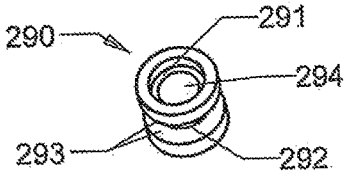
FIGS. 20A and 20B show different views of the locking ring.
Figure 20B:
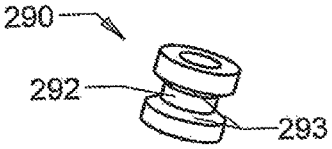
Figure 21:
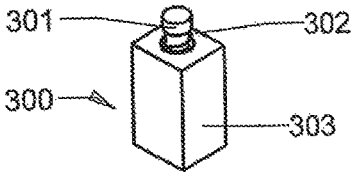
FIG. 21 shows a solenoid.

Unlock by Combination Code (FIG. 16)

When the user wants to operate the padlock 420, the user can touch the panel 270 to cause the keypad 230-239, the home button 250, and the set button 260 to be displayed on the panel. The user can type in a predetermined combination code and then press the home button 250. The electrical power is transferred to the solenoid 300 in a short period of time, about 10 seconds, for example. As the solenoid 300 is activated, the tip 301 of the solenoid 100 moves downward toward the solenoid body 3003. As the tip 301 of the solenoid 300 moves downward and out of the latch hole 281 of latch 280, the latch fork 282 is disengaged from the ring groove 292 of locking ring 290. As such, the user can pull the shackle 240 upward to release the short leg 241 out of the locking hole 351 of fixed cam 350 to operate the padlock in the opened mode. As the shackle 240 is pulled upward, the groove slope 293 of locking ring 290 also causes the latch 280 to move further way from the long leg 242 by pushing the fork slope 283 of latch 280. After about 10 seconds, the electrical power to the solenoid 300 can be cut off.

When the user relocks the padlock, the short leg 241 is moved into the locking hole 351 of fixed cam 350. At the same time, the locking ring 290, along with the long leg 242, move downward such that the groove of 292 aligns with the latch fork 282 of latch 280. The latch 280 is pushed by the urging force of the spring 380 and the latch fork 282 is caused to engage with the groove 292 of locking ring 290. As the solenoid 300 is no longer energized, the tip 301 of solenoid 300 is pushed upward by the spring 302 into the latch hole 281 of latch 280.

Figure 29A:
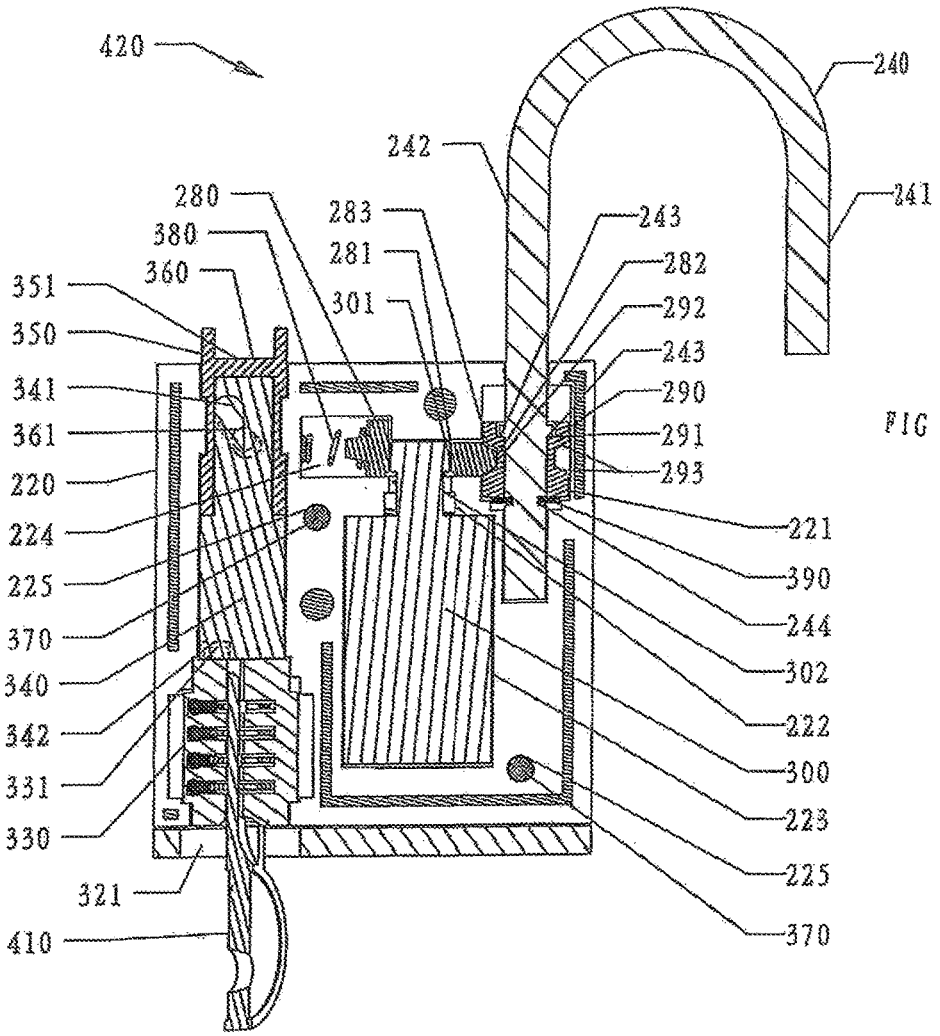
FIG. 29A shows a cross sectional view of the lock opened by a key.
Figure 29B:
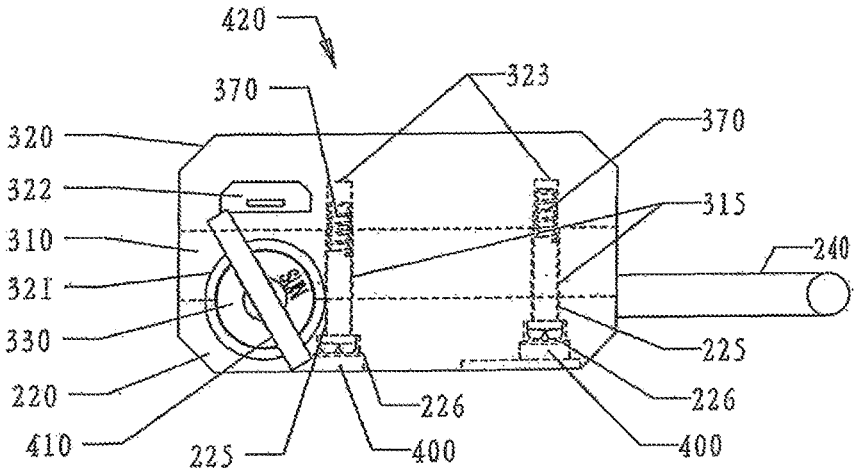
FIG. 29B shows a bottom view of the lock opened by a key.
Figure 30:
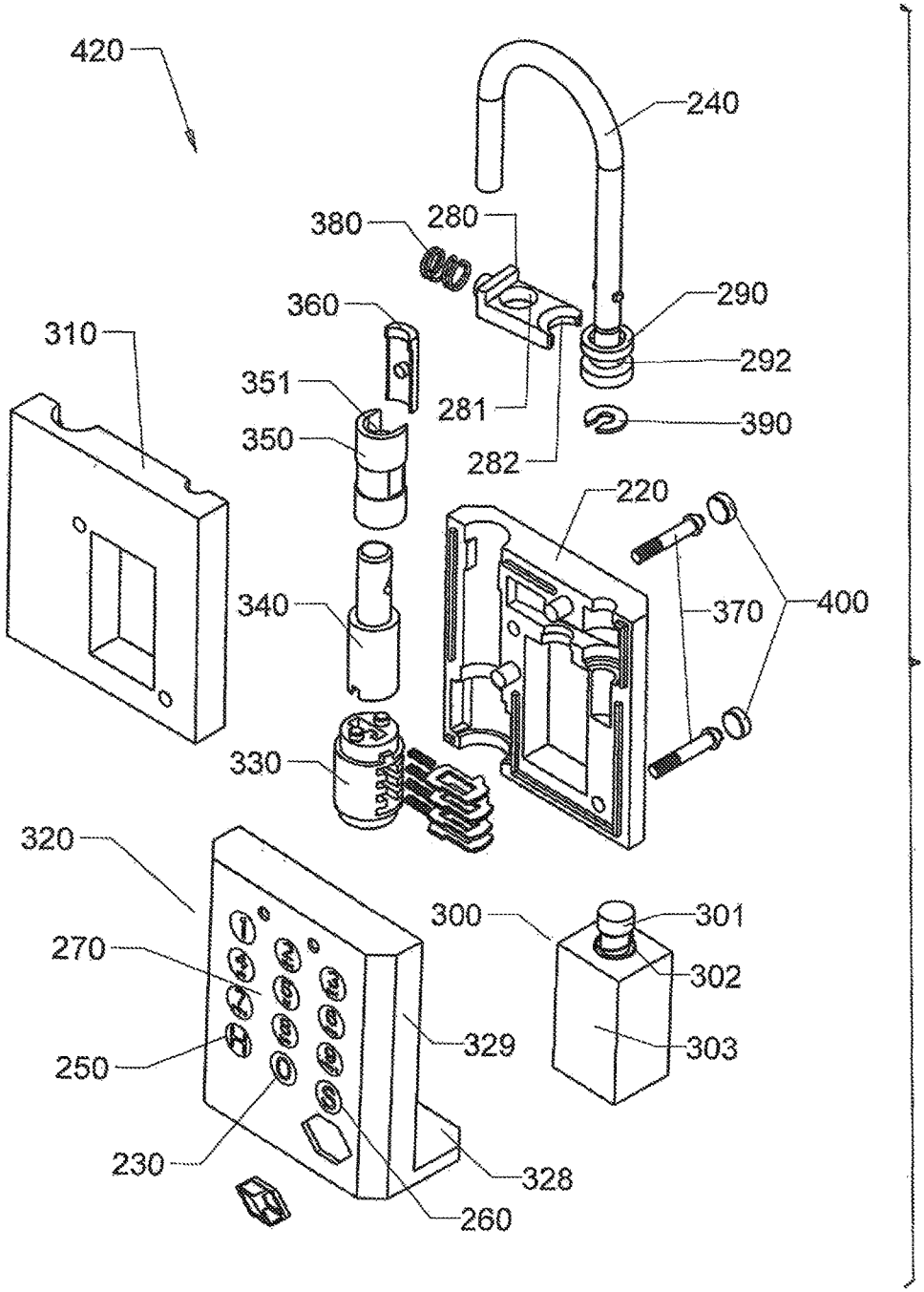
FIG. 30 is an exploded view of the lock showing varies component of the lock.

To Unlock by Key-Lock Mechanism (FIG. 29A and FIG. 29B)

When the padlock 420 is in the locked mode as the protrusion 243 is engaged with the groove 292 of the locking ring 290, the shackle 240 cannot be pushed upward to unlock the padlock 420. However, if a correct key 410 is inserted into the cylinder 330, the cylinder 330 can be rotated along with the rotatable cam 340. As the rotatable cam 340 is rotated, the cam slot 341 in the smaller cylindrical body 344 causes the locking pin 361 along with the blocking plate 360 to move downward to unblock the locking hole 351. As such, the short leg 241 of shackle 240 can be swung out of the locking hole 351 of fixed cam 350. This allows a key-lock user or a security officer to inspect a piece of luggage. To relock the padlock, simply rotate the short leg 241 of shackle 240 back into the locking hole 351 of fixed cam 350 and rotate the cylinder 330 in the opposite direction to remove the key 410. As the cylinder 300 is rotated in the opposite direction, the pin 361 is caused to move upward along with the blocking plate 360. As such, the blocking plate 360 prevents the short leg 241 of shackle 240 from being swung out of the locking hole 351. At all times, the long leg 342 of shackle 240 and the locking ring 290 remain in the downward position.

As with the embodiment as described and illustrated in FIGS. 1-13, various users can key in a combination code to unlock the combination lock and to reset the combination codes. The differences in the operating procedures with the embodiment as described and illustrated in FIGS. 14-30 are the green and red lights. The green light can be used to indicate the key entry is correct. The green light can also be arranged to flash during the reset mode.

Exemplary Padlock Components

Figure 31:
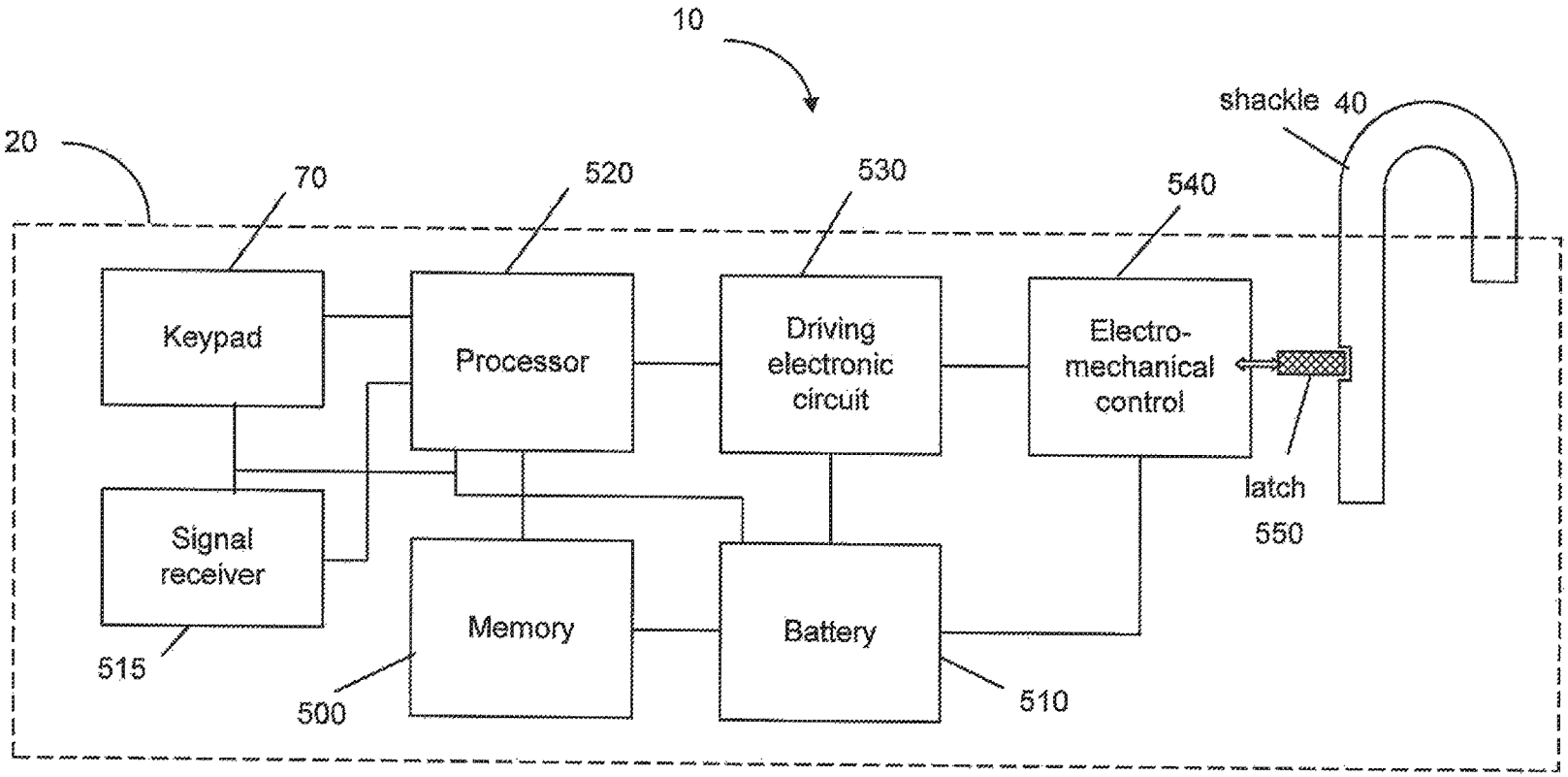
FIG. 31 is a block diagram showing some of the electronic components in the lock.
Figure 32:
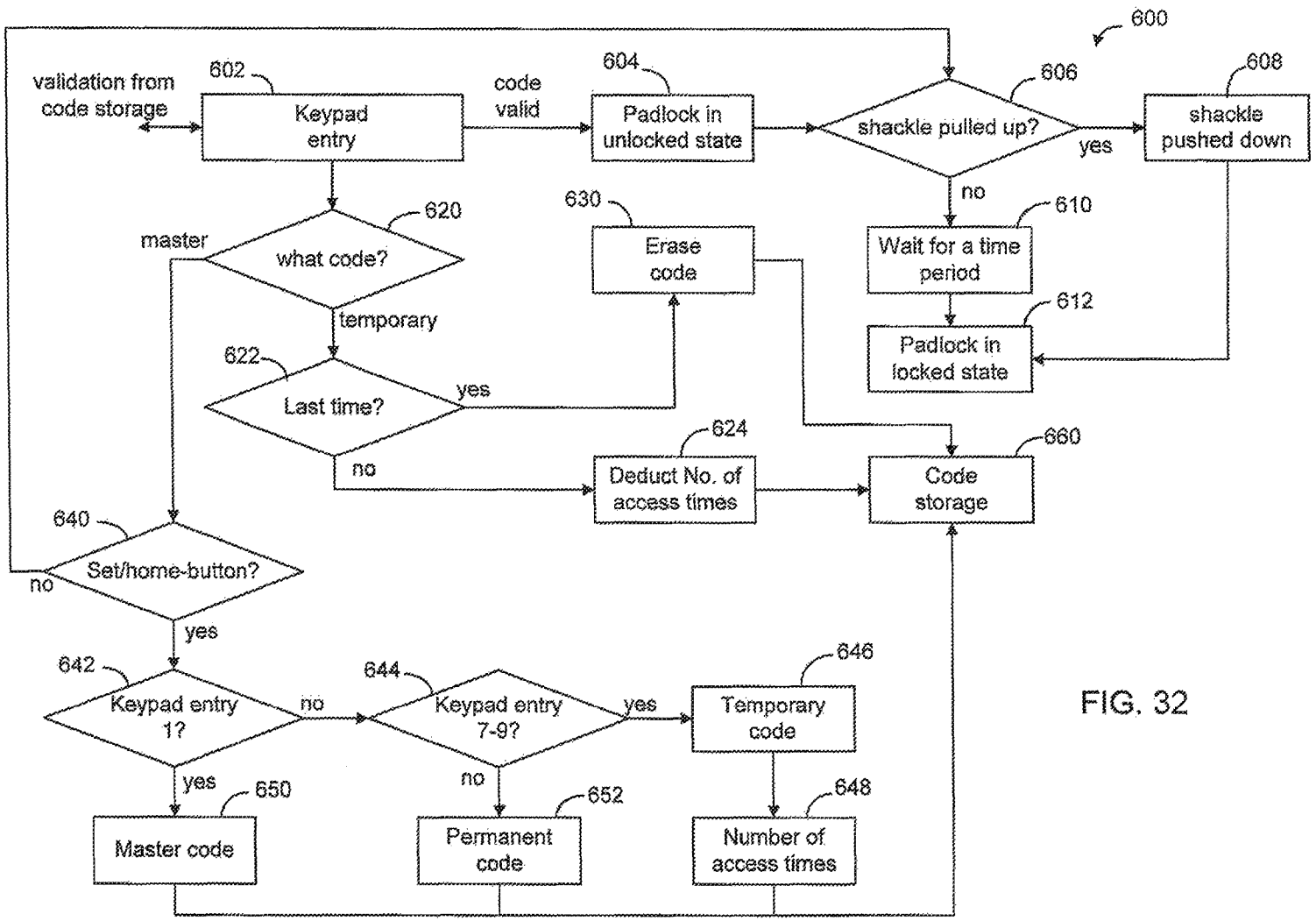
FIG. 32 is a flowchart illustrating a mode of operation, according to an embodiment of the present invention.

In an embodiment of the present invention, the padlock has various components as shown in FIG. 31. As shown in FIG. 31, the electronic padlock 10 includes:

a padlock housing or lock body 20; a keypad 70 for keypad entry; a processor 520 for receiving the keypad entry—the processor is programmed to carry out the mode of operation as shown in FIG. 32, for example; a memory 500 having a code storage to store codes and types of codes (the memory is a non-transitory for storing codes readable by the processor or a computer); a battery 510 to provide power to all the electronic components and electro-mechanical control; a driving electronic circuit 530 for driving the electro-mechanical mechanism or control 540 such as a solenoid which can change the positions of a mechanical latching device 550, such that when the mechanical latching device 550 is engaged in a notch or the like on the shackle 40, it prevents the shackle 40 from being pulled up to open the padlock. According to an embodiment of the present invention, the padlock housing 20 has an optional signal receiver 515 configured to receive an electronic signal from an electronic device indicative of a combination code and conveying the combination code to the processor 520.

Exemplary Mode of Operation

In an embodiment of the present invention, the electronic padlock can be operated according to processing steps as shown in FIG. 32 and described as follows:

Step 602: Upon receiving keypad entry from a user, if code is valid (as validated from the code storage) then the combination lock is in the unlocked state (state 604) and goes to step 620.

Step 604: Padlock is set in unlocked state and the process goes to step 606

Step 606: If shackle is pulled up, the process goes to step 608. If the shackle is pushed down at step 608, the padlock returns to locked state at step 612; if the shackle is not pulled up after a period of time as determined at step 610, the padlock returns to the locked state at step 612.

Step 620: the code type is determined: 1) if the code is a permanent code, nothing happens. 2) if the code is a temporary code and it is for the last access as determined at step 622, the code will be erased at step 630 and the code storage is adjusted accordingly at step 660; if the code is a temporary code and it can still be used for two or more times, the number of access times is reduced at step 624 and the code storage is adjusted accordingly; 3) if the code is a master code, it is determined at step 640 whether the user wants to reset the code. If the user wants to reset to code, the process goes to step 642; if not, the process goes to step 606.

Step 640: Upon receiving the reset entry from the user, the process goes to step 642.

Step 642: The user selects the type of code to be reset: if the type is master code, then the process goes to step 650, otherwise the process goes to step 644.

Step 644: If the type is a temporary code, the process goes to step 646. Otherwise the process goes to step 652.

Step 646: After the new temporary code is entered, the process goes to step 648.

Step 648: The user enters the number of access times for the temporary code, the code storage is adjusted accordingly at step 660.

Step 650: the user inputs a code as the new master code, the code storage is adjusted accordingly at step 660.

Step 652: the user inputs a code as the new permanent code, the code storage is adjusted accordingly at step 660.

Another Embodiment of the Present Invention

According to another embodiment of the present invention, the use of a touch screen panel 70 is not required. Accordingly, the numerical keypad 30-39 is affixed onto the panel-base 120/320. In particular, the numerical pad is already on the panel-base 120/320 for a user to input the combination code.

Remote Entry of Combination Code

In an embodiment of the present invention, the combination code can also be conveyed to the electronic processor 520 by an electronic device that is detached from the electronic combination lock. As seen in FIG. 31, the padlock housing 20 has a signal receiver 515 electrically connected to the electronic processor 520. The signal receiver 515 is configured to receive an electronic signal indicative of a combination code and to convey the received combination code to the electronic processor 520 to determine if the combination code matches a preset code (stored code). The electronic signal can be a Bluetooth signal from an electronic device such as a cellphone, or a longer-range signal from a remote transmitter.

With the signal receiver, a user can open the electronic combination lock by entering the combination code through the touch panel or by sending an electronic signal indicative of the combination code from a detached electronic device.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. An electronic combination lock, comprising:

a shackle having a short leg and a long leg, a lock body comprising a long-leg channel dimensioned to receive the long leg of the shackle, the shackle locatable in a first shackle position in relationship to the lock body when the combination lock is operated at least in a locked mode and in a second shackle position when the combination lock is operated in an opened mode;

a locking mechanism configured to engage with the shackle for securing the shackle in the first shackle position when the combination lock is operated in the locked mode;

an electromechanical device coupled to the locking mechanism;

an electronic keypad configured to receive a combination code for operating the combination lock at one of a plurality of access levels, the access levels comprising a first level, a second level and a third level; and an electronic processor configured to control the electromechanical device based on the combination code, such that when the combination code matches a preset code, the locking mechanism is caused to disengage from the shackle, causing the combination lock to operate in an unlocked mode, wherein when the combination lock is operated in the unlocked mode, the shackle can be caused to change from the first shackle position to the second shackle position so as to operate the combination lock in the opened mode, and wherein the preset code is indicative of one of the plurality of access levels of the combination lock, wherein the combination code for the first level is indicative of a permission to access the combination lock an unlimited number of access times and a permission to change the preset code for all of the access levels, the combination code for the second level is indicative of a permission to access the combination lock, and the combination code for the third level is indicative of a permission to access the combination lock and indicative of a prohibition from changing the preset code for any of the access levels, and wherein the electronic processor is configured to determine the access level based on the combination code.

2. The electronic combination lock according to claim 1, wherein the electronic keypad further comprises a reset button configured to provide to the electronic processor an electronic signal indicative of a procedure to change the preset code.

3. The electronic combination lock according to claim 1, wherein the lock body further comprises a locking hole dimensioned to receive the short leg of the shackle, such that when the combination lock is operated in the locked mode and in the unlocked mode, the short leg of the shackle is engaged with locking hole, and when the combination lock is operated in the opened mode, the short leg of the shackle is disengaged from the locking hole, said electronic combination lock further comprising a locking ball and a locking bolt, the locking body further comprising a bolt hole dimensioned to receive the locking ball and the locking bolt, and wherein each of the short leg and the long leg of the shackle comprises a cutout, such that when the combination lock is operated in the locked mode, the locking mechanism is configured to engage the locking bolt with the cutout in the short leg and to engage the locking ball with the cutout in the long leg, preventing movement of the shackle from the first shackle position to the second shackle position.

4. The electronic combination lock according to claim 3, wherein the long-leg channel comprises a longitudinal axis, and wherein the locking mechanism further comprises a rotatable cam rotatable about an axis substantially parallel to the longitudinal axis of the long-leg channel, the rotatable cam operable in a first cam position and a second cam position, and wherein when the rotatable cam is operated in the first cam position, the rotatable cam is configured to prevent disengagement of the locking bolt from the cutout in the short leg and disengagement of the locking ball from the cutout in the long leg, and when the rotatable cam is operated in the second cam position, the rotatable cam is configured to allow the locking bolt to disengage from the cutout in the short leg and allow the locking ball to disengage from the cutout in the long leg so as to allow the shackle to move from the first shackle position to the second shackle position, wherein the locking mechanism further comprises a cam ball and the rotatable cam comprises an indent arranged to engage with the cam ball in order to keep the rotatable cam in the first cam position when the combination lock is operated in the locked mode.

5. The electronic combination lock according to claim 4, wherein when the combination code matches the preset code, the electromechanical device is configured to disengage the cam ball from the indent of the rotatable cam, allowing the rotatable cam to move from the first cam position to the second cam position so as to operate the combination lock in the unlocked mode.

6. The electronic combination lock according to claim 5, wherein the electromechanical device comprises a solenoid having a tip locatable in a first tip position to keep the rotatable cam in the first cam position and in a second tip position to allow the rotatable cam to move from the first cam position to the second cam position.

7. The electronic combination lock according to claim 6, wherein when the combination code matches the preset code, the tip of the solenoid is caused to move from the first tip position to the second tip position.

8. The electronic combination lock according to claim 1, wherein the lock body further comprises a locking hole dimensioned to receive the short leg of the shackle, such that when the combination lock is operated in the locked mode and in the unlocked mode, the short leg of the shackle is engaged with locking hole, and when the combination lock is operated in the opened mode, the short leg of the shackle is disengaged from the locking hole, and wherein the locking mechanism comprises a latch and a locking ring, the latch having a latch fork, wherein the locking ring is dimensioned to rotatably attach to the long leg of the shackle and the locking ring comprises a circular groove dimensioned to receive the latch fork, such that when the combination lock is operated in the locked mode, the latch fork is engaged with the circular groove of the locking ring so as to prevent movement of the shackle from the first shackle position to the second shackle position.

9. The electronic combination lock according to claim 8, wherein the long-leg channel comprises a longitudinal axis, and wherein the electromechanical device comprises a solenoid having a tip locatable in a first tip position to maintain engagement of the latch fork with the circular groove of the locking ring, and in a second tip position to disengage the latch fork from the locking ring so as to allow the shackle to move from the first shackle position to the second shackle position in a direction substantially parallel to the longitudinal axis of the long-leg channel, wherein when the combination code matches the preset code, the tip of the solenoid is caused to move from the first tip position to the second tip position.

10. The electronic combination lock according to claim 8, further comprising a cylinder, a rotatable cam coupled to the cylinder;

a fixed cam positioned in relationship to the rotatable cam for providing the locking hole; and a blocking plate movably attached to the rotatable cam, the blocking plate locatable in a first plate position for blocking the locking hole and in a second plate position for unblocking the locking hole, such that when the cylinder is caused to rotate by a matching key, the rotatable cam is configured to move the blocking plate from the first plate position to the second plate position so as to operate the combination lock in the unlocked mode.

11. The electronic combination lock according to claim 10, wherein the long-leg channel comprises a longitudinal axis, and wherein when the blocking plate is located in the second plate position, the shackle is allowed to rotate about the long-leg in a direction substantially perpendicular to the longitudinal axis so as to operate the combination lock in the opened mode.

12. The electronic combination lock according to claim 8, wherein the long-leg channel comprises a longitudinal axis, and the latch is movable in a direction substantially perpendicular to the longitudinal axis of the long-leg channel.

13. The electronic combination lock according to claim 1, further comprising:

an electronic signal receiver configured to receive an electronic signal indicative of the combination code and to provide the combination code to the electronic processor so as to allow the electronic processor to determine whether the combination code matches the preset code.

14. The electronic combination lock according to claim 1, wherein the combination code for the third level is further indicative of a permission to access the combination lock a limited number of access times, and the combination code for the second level is further indicative of a permission to access the combination lock an unlimited number of access times.

15. The electronic combination lock according to claim 1, wherein the combination code for the second level is also indicative of a permission to change the preset code for the second level, as authorized by the combination code for the first level.

16. A method for controlling an electronic combination lock operable in a locked mode, an unlocked mode and an opened mode, the electronic combination lock comprising a lock body, a shackle locatable in a first shackle position in relationship to the lock body when the combination lock is operated in the locked mode and in a second shackle position when the combination lock is operated in the opened mode, the shackle having a short leg and a long leg, said method comprising:

providing a long-leg channel in the lock body to receive the long leg of the shackle;

providing a locking mechanism in the lock body, the locking mechanism arranged to engage with the shackle for securing the shackle in the first shackle position when the combination mode is operated in the locked mode;

providing an electromechanical device in the lock body, coupled to the locking mechanism;

providing an electronic keypad on the lock body, configured to receive a combination code; and providing an electronic processor in the lock body for controlling the electromechanical device based on the combination code, such that when the combination code matches a preset code, the electromechanical device is arranged to disengage the locking mechanism from the shackle, causing the combination lock to operate in the unlocked mode, and when the combination lock is operated in the unlocked mode, the shackle can be caused to change from the first shackle position to the second shackle position so as to operate the combination lock in the opened mode, and wherein the preset code is indicative of one of a plurality of access levels of the combination lock, the access levels comprising a first level, a second level and a third level, wherein the preset code for the first level is indicative of a permission to access the combination lock an unlimited number of access times and to change the preset code for all of the access levels, the preset code for the second level is indicative of a permission to access the combination lock an unlimited number of access times, and the preset code for the third level is indicative of a permission to access the combination lock a limited number of access times and also indicative of a prohibition from changing the preset code for any of the access levels, wherein the electronic processor is configured to determine the access level based on the combination code.

17. The method according to claim 16, further comprising:

providing a reset button on the electronic keypad, the reset button configured to provide the electronic processor an electronic signal indicative of a procedure to change the preset code.

18. The method according to claim 17, wherein the combination code for the second level is also indicative of a prohibition from using the reset button.

19. The method according to claim 16, further comprising:

providing an electronic signal receiver configured to receive an electronic signal indicative of the combination code and to provide the combination code to the electronic processor so as to allow the electronic processor to determine whether the combination code matches the preset code.

20. The method according to claim 16, wherein the combination code for the second level is also indicative of a permission to change the preset code for the second level, as authorized by the combination code for the first level.

* * * * *